US005802772A

United States Patent [19]

Burke et al.

[11] Patent Number: 5,802,772

[45] Date of Patent: Sep. 8, 1998

[54] RELEASEABLE JOINT FOR JOINING TWO CONSTRUCTION ELEMENTS AND TRANSPORTABLE CONSTRUCTION COMPRISING SAME

[75] Inventors: Jeffrey Richard Burke, Kent; Oliver Charles Watts, London, both of England

[73] Assignee: Edwin Shirley Trucking, Ltd., London, England

[21] Appl. No.: 569,170

[22] PCT Filed: Apr. 27, 1995

[86] PCT No.: PCT/GB95/00967

§ 371 Date: Apr. 16, 1996

§ 102(e) Date: Apr. 16, 1996

[87] PCT Pub. No.: WO95/30062

PCT Pub. Date: Nov. 9, 1995

[30] Foreign Application Priority Data

Apr. 28, 1994 [GB] United Kingdom ..... 9408499

[51] Int. Cl.[6] ..... E04H 3/10

[52] U.S. Cl. ..... 52/6; 52/7; 52/637; 52/651.1; 52/651.01; 52/653.2; 52/654; 52/655.1; 52/656.9

[58] Field of Search ..... 52/6, 7, 650.1, 52/637, 651.01, 651.02, 651.1, 653.2, 654.1, 655.1, 656.9; 472/91; 403/361, 109, 110

[56] References Cited

U.S. PATENT DOCUMENTS

| | | | |
|---|---|---|---|
| 3,417,518 | 12/1968 | Jaffe | 52/7 |
| 4,026,076 | 5/1977 | Analetto | 52/7 X |
| 4,939,875 | 7/1990 | Fujita . | |
| 5,205,101 | 4/1993 | Swan et al. | 52/6 X |
| 5,388,376 | 2/1995 | Heari | 52/6 |

FOREIGN PATENT DOCUMENTS

| | | | |
|---|---|---|---|
| 2237480 | 2/1975 | France . | |
| 2273115 | 6/1994 | United Kingdom . | |
| 2273115 | 8/1994 | United Kingdom | 52/6 |
| WO9303240 | 2/1993 | WIPO . | |

*Primary Examiner*—Creighton Smith
*Assistant Examiner*—W. Glenn Edwards
*Attorney, Agent, or Firm*—Mathews, Collins, Shephard & Gould, P.A

[57] ABSTRACT

A releasable joint for joining two construction elements of a transportable construction. Also a construction element adapted for use in making the releasable joint, and a construction, such as a portable building or stage assembly, comprising a plurality of construction elements joined by the releasable joint.

16 Claims, 17 Drawing Sheets

RELEASEABLE JOINT FOR JOINING TWO CONSTRUCTION ELEMENTS AND TRANSPORTABLE CONSTRUCTION COMPRISING SAME

The present invention relates to a releasable joint for joining two construction elements of a transportable construction. The invention also includes a construction element which is adapted for use in making a releasable joint in accordance with the invention, and a construction such, for example, as a portable building or stage assembly comprising a plurality of the construction elements which are joined releasably one to another by a releasable joint in accordance with the present invention.

Transportable stage assemblies are used in the entertainments industry for providing stages at venues which do not include permanent stages in situ. For example, in the music industry, transportable stage assemblies are commonly used for staging concerts in large capacity venues such, for example, as multi-purpose "exhibition" halls, sports stadia and outdoor locations in fields or on pasture land. A typical transportable stage assembly comprises an elevated stage area constituted by a plurality of floor panels supported by scaffolding, and a roof construction disposed above the stage area for carrying a weatherproof canopy for shielding performers and equipment on the stage area from the weather, stage lighting and other equipment for use during the concert. At the time of writing, such a roof construction is typically supported by scaffolding disposed in juxtaposition with the side margins of the stage area.

It will be understood by a person skilled in the art that it is desirable for a transportable stage assembly to be capable of assembly and disassembly in as short a time as possible. The cost of hiring a venue can be very expensive, and it is desirable therefore to reduce as far as possible the time required for setting up and dismantling the stage assembly.

Furthermore, in the case of transportable stage assemblies used by the entertainments industry for tours comprising performances at a plurality of successive venues typically one shortly after another, there is a general requirement to reduce the time taken to set up and dismantle the stage assembly to reduce the possibility of mistakes in assembly and disassembly of the stage which is typically carried out by local work forces at each venue, and to minimise the volume occupied by the stage assembly when packed in order to reduce the cost of transporting the stage assembly from one venue to the next. To this latter end, in particular, there is a general requirement to make each component of a transportable construction and the connections between such components as strong as possible so as to reduce the overall volume of components needed to make a construction of a given specification. Clearly the fewer components that are needed, the less the transport capacity that will have to be provided.

In order to meet some or all of the above mentioned requirements the inventors have developed the present invention which, in one aspect, provides a releasable joint for joining two construction elements of a transportable construction such, for example, as a stage assembly or building, said releasable joint comprising:

one end of one construction element;

a spigot member, one end of which spigot member is carried by the one end of the one construction element and another end of which spigot member has a first aperture formed therein;

another end of another construction element which defines a recess adapted to receive the other end of the spigot member and has a second aperture formed therein which can be aligned with the first aperture when the other end of the spigot member is received in the recess;

a non-threaded spigot securing member which can be entered into the first and second aligned apertures; and a releasable securing means for securing releasably the spigot securing member in the first and second aligned apertures;

the arrangement being such that, in service, the other end of the spigot member can be entered into the recess such that the first and second apertures are aligned one with the other, whereafter the non-threaded spigot securing member can be entered into the first and second aligned recesses thereby to secure the other end of the spigot member in the recess, thereby to join releasably the one end of the one construction element to the other end of the other construction element, and the spigot securing member can itself be secured in place by the releasable securing means.

The present invention therefore provides a means for joining the construction elements of a transportable stage assembly one to another which facilitates rapid assembly and disassembly of the stage assembly. In particular, the use of a non-threaded spigot securing member for securing the other end of the spigot member in the recess of the other end of the other construction element eliminates the need to use nuts and bolts for securing the construction elements together which, it will be understood, is significantly more time consuming than the use of the non-threaded spigot securing member of the present invention, particularly when the threads of such nuts and bolts become damaged through repeated use.

In another aspect of the present invention there is provided a construction element for use in making a releasable joint in accordance with the present invention, said construction element comprising first and second ends, wherein one of said first and second ends carries one end of a spigot member, another end of which spigot member has a first aperture formed therein, and the other end of the construction element defines a recess which is adapted to receive the other end of another spigot member of another similar construction element, and has a second aperture formed therein which can be aligned with the first aperture of the other spigot member when the other end of the other spigot member is received in the recess of the one construction element.

The present invention also comprehends, in yet another aspect, a transportable construction comprising a plurality of construction elements in accordance with the other aspect of the present invention, wherein said construction elements are joined releasably one to another by a releasable joint in accordance with the one aspect of the present invention. Said construction, in some embodiments may be a transportable stage assembly or a portable building, marquee or the like.

Said construction may comprise a roof. In a particular aspect of the invention, the construction may comprise a tower for supporting a roof.

Typically, the construction will comprise a roof and a plurality of towers for supporting the roof. Where the construction is a stage assembly, an elevated stage will additionally be provided.

In some embodiments the construction elements for use in the roof may be interchangeable with the construction elements for use in a tower, thereby reducing the total number of different parts which need to be used as compared with prior art transportable stage assemblies, and thus simplifying the assembly/disassembly of the construction.

Said non-threaded spigot securing member may comprise a non-threaded pin having a head portion and a stem portion which can be entered into the said first and second aligned apertures. Typically, the releasable securing means may comprise a releasable clip which can be inserted into an open bore formed through the stem portion remote from the head portion; said releasable clip may be a split pin or an R-clip.

In some embodiments of the invention, the spigot member maybe formed integrally with the one end of the one construction element. Alternatively, the one end of the spigot member maybe fixedly secured in a recess formed in the one end of the one construction element. The one end of the spigot member may be secured in the recess e.g. semi-permanently by means of one or more bolts entered into aligned apertures formed in the one end of the one construction element and the one end of the spigot member and fixedly secured in place by corresponding nuts. In another embodiment of the invention, the one end of the spigot member may be welded in the recess.

Typically, the construction element in accordance with the invention may comprise a truss comprising a plurality, typically two spaced, substantially parallel, elongate chord portions which are braced by bracing means. Typically, each chord portion maybe constituted by a hollow tube. Said tube may be rectilinear or circular in cross section, typically square or rectangular.

The recess formed in the one end of the construction element and the other, first-mentioned recess formed in the other end may each be constituted by the bore of one of the chord portions in juxtaposition respectively with the one and other ends of the construction element.

In some embodiments, the recesses formed in the one and other ends may be substantially identical one to the other. Typically, each of the chord portions may define a first recess at the first end of the construction element and a second recess at the second end such that the one construction element can be joined releasably to the other, similar construction element by means of a plurality of releasable joints in accordance with the present invention.

Said bracing means may comprise a plurality of brace portions which are disposed generally transversely of the elongate chord portions. Thus, in certain embodiments of the invention, the truss may be generally rectangular, having two long sides defined by parallel, elongate the chord portions. The brace portions may include two end braces disposed one at or towards each of the longitudinal first and second ends of the truss and extending substantially transversely therebetween to form the short sides of the rectangle. In addition the brace portions will typically comprise at least one diagonal brace portion which extends between the two chord portions in direction having components in the longitudinal and transverse directions.

The construction elements forming the construction in accordance with the invention may be arranged in two or more spaced, substantially parallel rows (in the case of a roof) or columns (in the case of a tower). Each row may comprise a plurality of construction elements, each joined one to another by at least one releasable joint in accordance with the one aspect of the invention.

Each row or column may be releasably secured to a neighbouring row or column by a releasable bracing means. Typically, said releasable bracing means may comprise a plurality of spaced releasable brace means. The releasable bracing means will usually be employed to brace one truss of one row or column with a corresponding truss in a neighbouring row or column as the case may be. Thus, where rectangular trusses of the kind described above are employed, the construction will, in each row or column, comprise a series of box-like structures formed of two cooperating trusses and associated bracing means which the Applicants have found to posses great load-bearing strength.

In some embodiments, each releasable brace means may comprise a brace member having first and second ends, wherein each of said first and second ends is releasably secured to a respective construction element included in a respective one of the neighbouring rows or columns by a releasable brace securing means.

Said releasable brace securing means may comprise a bracket member which is carried on the end of the brace member, and bracket securing means for securing the bracket member releasably to the respective construction element. Typically, said bracket member may have an aperture formed therein which can be aligned with a corresponding aperture formed in the respective construction element; a non-threaded bracket securing member can be entered through the aligned apertures and retained in position by a releasable securing means, such or example as a split-pin or an R-clip.

In accordance with a further aspect of the present invention, at least one brace member may be secured, at one end, to a respective construction member in juxtaposition with said other end of the respective construction element, and the aperture formed in the bracket member may be aligned with the said second aperture formed in the other end of the respective construction element and the first aperture formed in the other end of the spigot member, and may be secured releasably to the respective construction element by the non-threaded spigot securing member which is entered through the aligned apertures formed in the bracket member, the other end of the construction element and the spigot member. The bracket member itself may be fixedly secured to the end of the brace member as for example by welding.

Thus, at least one of the spigot securing members included in the construction, in addition to securing releasably the spigot member in the recess formed in the other end of the other construction element may also be used to secure releasably the one end of the brace member to the other end of the other construction element. Such an arrangement has the advantage of reducing the total number of parts required for assembling the structure in accordance with the present invention and for reducing the number of operations, and thus the time, required for such assembly.

As mentioned above, the Applicants have found that the use of trusses described herein to form towers for supporting a roof has the advantage that such towers are significantly stronger than the scaffolding used in the prior art for this purpose. For a roof having a payload of the order of say forty tons, only six towers in accordance with the present invention may be required (only four towers may be needed where a payload of less than forty tons is required). It will be understood by a person skilled in the art therefore that for a construction of a given specification, the present invention will require fewer components and thus occupy less space when disassembled and packed, for example onto lorries, as compared with the prior art stage assemblies which employ scaffolding for supporting the stage roof. The use of towers in accordance with the invention may therefore significantly reduce the cost of transporting a construction such as a stage assembly from one venue to another on a tour.

The present invention is not restricted to transportable stage assemblies, but can be used to form portable buildings to provide temporary venues of up to potentially very large capacities, by building a roof to cover the desired area, and providing the number of towers required to support the roof at the desired height. The roof and towers can, if desired, be covered by a weather-proof canopy to protect the enclosed space.

In a particular aspect of the present invention, a tower construction may be provided with a pivot means between two neighbouring trusses towards the lower end of the erect tower, such that the upper portion of the tower above the pivot means can be assembled horizontally on the ground from its constituent construction elements and then raised into its erect position by pivoting it by the pivot means.

A hydraulic ram may be used to apply the turning moment necessary about the pivot means for lifting the upper part of the tower to its erect position. Where a plurality of towers are to be erected, the ram can be moved about the site from one tower to another on a movable "dolly". A releasable coupling means may be provided for coupling releasably the piston(s) of the ram to the tower for lifting. The ram can then be decoupled and moved to the next tower.

Typically, the pivot means may be incorporated in a pivotable construction element which is adapted for forming releasable joints with the upper and lower parts of the tower in the manner herein described, and includes releasable coupling means for coupling to the hydraulic ram.

Following is a description by way of example only with reference to the accompanying drawings of methods of carrying the present invention into effect:

Figure 1:
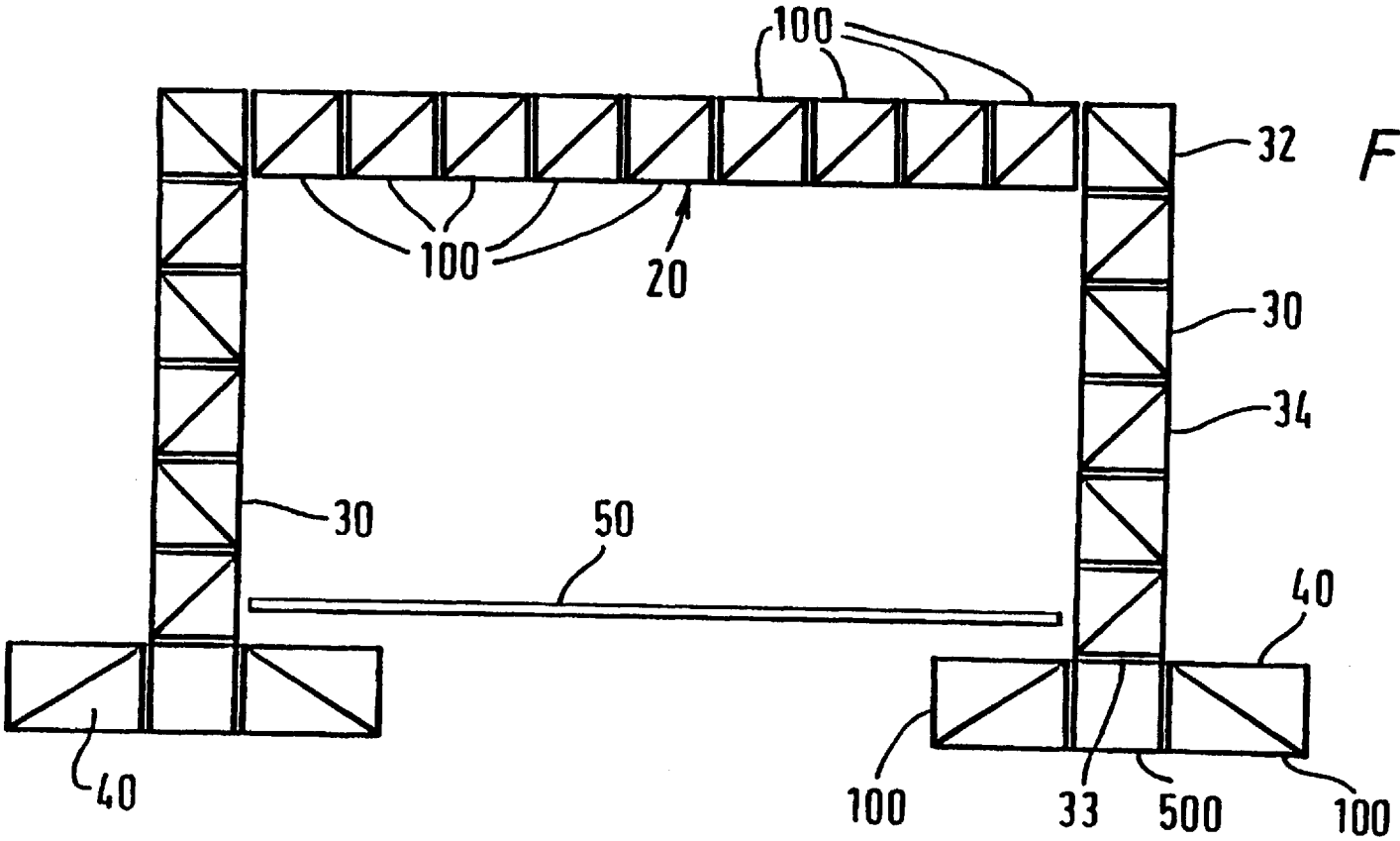
FIG. 1 is a schematic front elevation of a simplified stage assembly according to the present invention.
Figure 2:
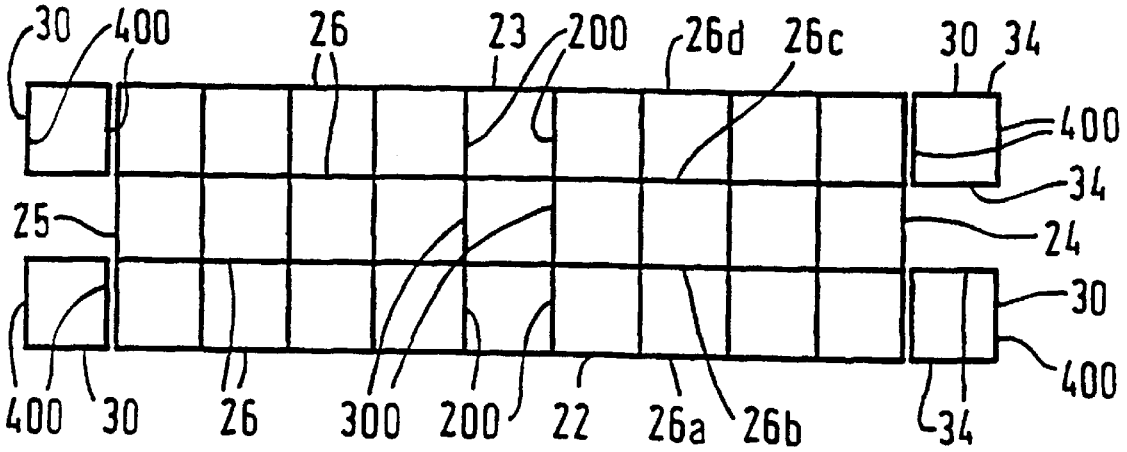
FIG. 2 is a schematic plan view of the simplified stage assembly of FIG. 1.

A simplified stage assembly which is shown in FIGS. 1 and 2 is described first to illustrate the principal features of the present invention. The simplified assembly includes a roof (20) supported by a plurality of upstanding towers (30). Each tower (30) is supported on the ground by a tower base (40). The stage assembly also includes an elevated stage (50) (see FIG. 1) comprising a plurality of rectangular floor panels disposed one contiguous another so as to form a continuous floor surface; the floor panels are supported by a scaffolding (not shown).

In the simplified embodiment shown in the drawings, the roof (20) is supported by four towers (30); each tower (30) is joined juxtaposed its upper extremity (32) to the roof (20) for supporting the latter. It will be appreciated that in practice different numbers of towers (30) can be used in accordance with the present invention depending on the required payload of the roof (20). The Applicants have found for a stage assembly of the kind typically required by the entertainments industry for concert tours, that six such towers (30) are suitable for supporting a roof (20) having a payload up to about forty tons; fewer towers than six can be used for payloads less than forty tons.

The roof (20) is generally rectangular in plan view (see FIG. 2) and has an up-stage end (22), a down-stage end (23) and first and second sides (24,25) respectively which extend between the up- and down-stage ends (22,23) substantially orthogonally to the cross-stage direction.

The roof (20) is formed in the main from a plurality of trusses (100) (see FIG. 3) which are joined releasably one to another to form a plurality of rows (26) as shown in FIG. 2, which rows are spaced one from another in the up/down-stage direction. The simplified example of the invention illustrated in FIGS. 1 and 2 has four rows (26); each row (26) is formed of nine trusses (100). It will be appreciated however that in practice different numbers of rows and trusses (100) can be used in accordance with the present invention to provide a roof of sufficient dimensions to cover the desired stage area, and to carry all the equipment and lighting required for use during a concert.

Figure 3:
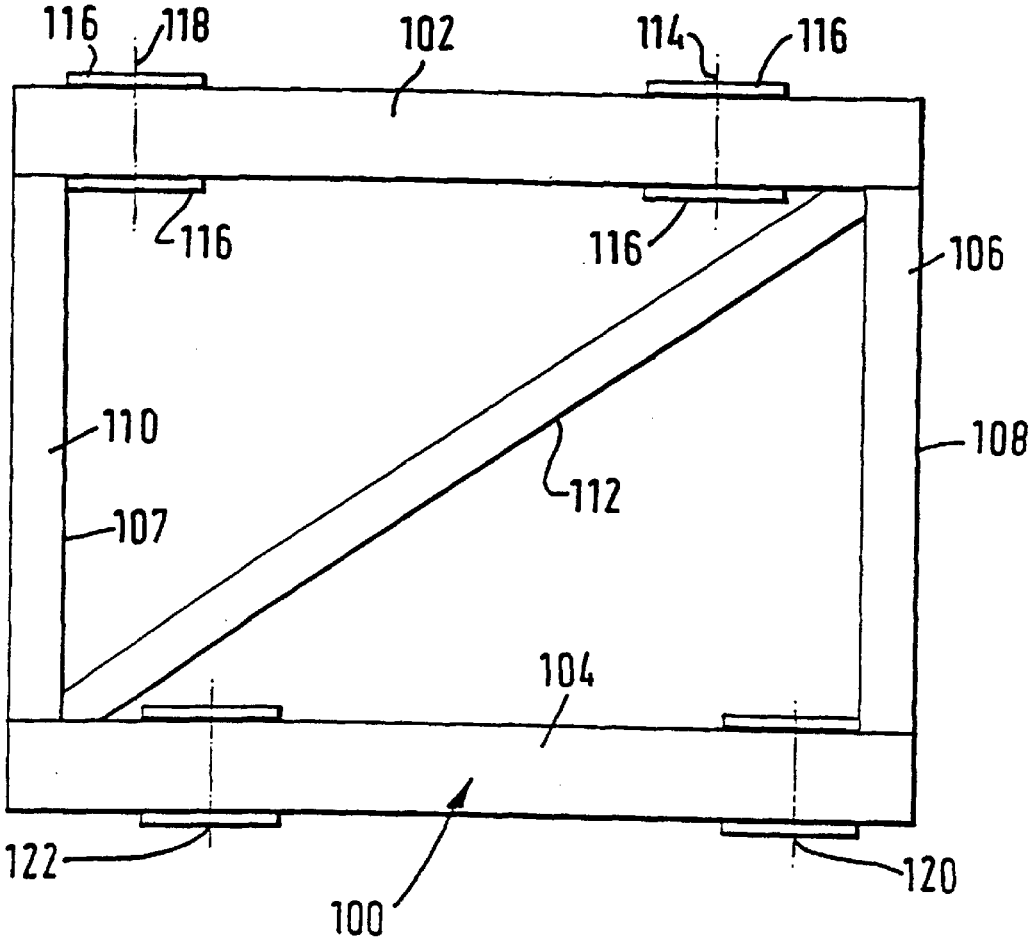
FIG. 3 is a side elevation of a construction member according to the present invention.

With reference to FIG. 3, each truss (100) comprises first and second spaced, substantially parallel, elongate chord portions (102,104) which, in the assembled roof (20) are spaced vertically one from the other. Each of said first and second chord portions (102,104) extends between a first end (106) and a second end (107) of the truss (100) and is constituted by a length of steel tube of substantially rectangular or square cross-section.

Said first and second chord portions (102,104) are interconnected by a first transverse brace portion (108) which extends between the first ends (106) of the first and second chord portions (102,104); a second transverse brace portion (110) which extends between the second ends (107) of the first and second chord portions (102,104), and a diagonal brace portion (112) which extends between the first end of the first chord portion (102) and the second end of the second chord portion (104). Each of the first and second transverse brace portions and said diagonal brace portion (112) is constituted by a length of steel tube of substantially rectangular or square cross-section.

The first chord portion (102) is drilled juxtaposed its first end (106) to provide a first hole (114) (indicated by the chain dotted line in FIG. 3) which extends substantially vertically through the upper and lower walls of the first chord portion (102). Said hole (114) is overlaid on the exterior surface of each of said upper and lower walls by a cheek plate (116) which is welded to said exterior surface and is drilled to provide a hole in alignment with the hole (114) through the first chord portion (102). The purpose of the cheek plates (116) is to reinforce the chord portion (102) in the area of said first hole (114).

The first chord portion (102) is provided with a second hole (118) in juxtaposition with the second end (107) of the first chord portion (102), which second hole (118) is reinforced by cheek plates (116) in the same way as said first hole (114).

The second chord portion (104) is also provided with first and second holes (120,122) in the same way as the first chord portion (102) as show in FIG. 3.

Figure 4:
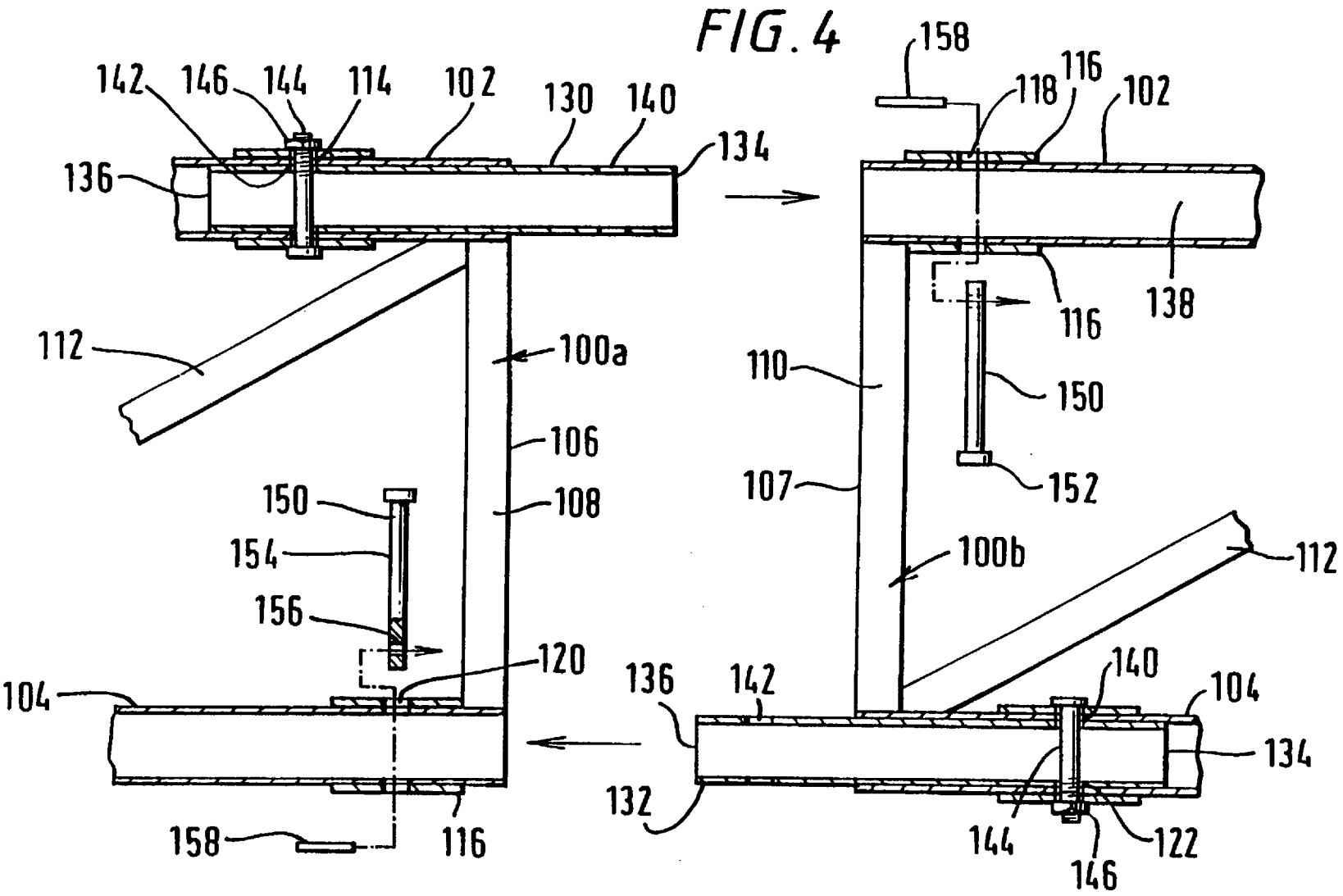
FIG. 4 is a side elevation of a releasable joint in accordance with the present invention.

Each truss (100) is releasably joined to its neighbouring truss(es) (100) within its row (26) by a releasable joint as shown in FIG. 4. This method of joining two construction members (100) is common to the simplified example shown in FIGS. 1 and 2 and to more sophisticated constructions which will be used in practice as hereinafter described.

Said releasable joint comprises a first spigot member (130) and a second spigot member (132). Each of said first and second spigot members (130,132) is constituted by a length of steel tube of generally rectangular or square cross-section and has a first end (134) and a second end (136). Each of said first and second spigot members (130, 132) is dimensioned to form a close fit, within a reasonable manufacturing tolerance, in the bore defined by one of said first and second hollow chord portions (102,104), and is drilled in juxtaposition with said first end (134) to provide a hole (140) which extends substantially vertically through the upper and lower walls of the spigot member (130,132) and in juxtaposition with said second end (136) to provide a second similar hole (142). Each spigot member including a male end that enters an open end of a next section.

Figure 5:
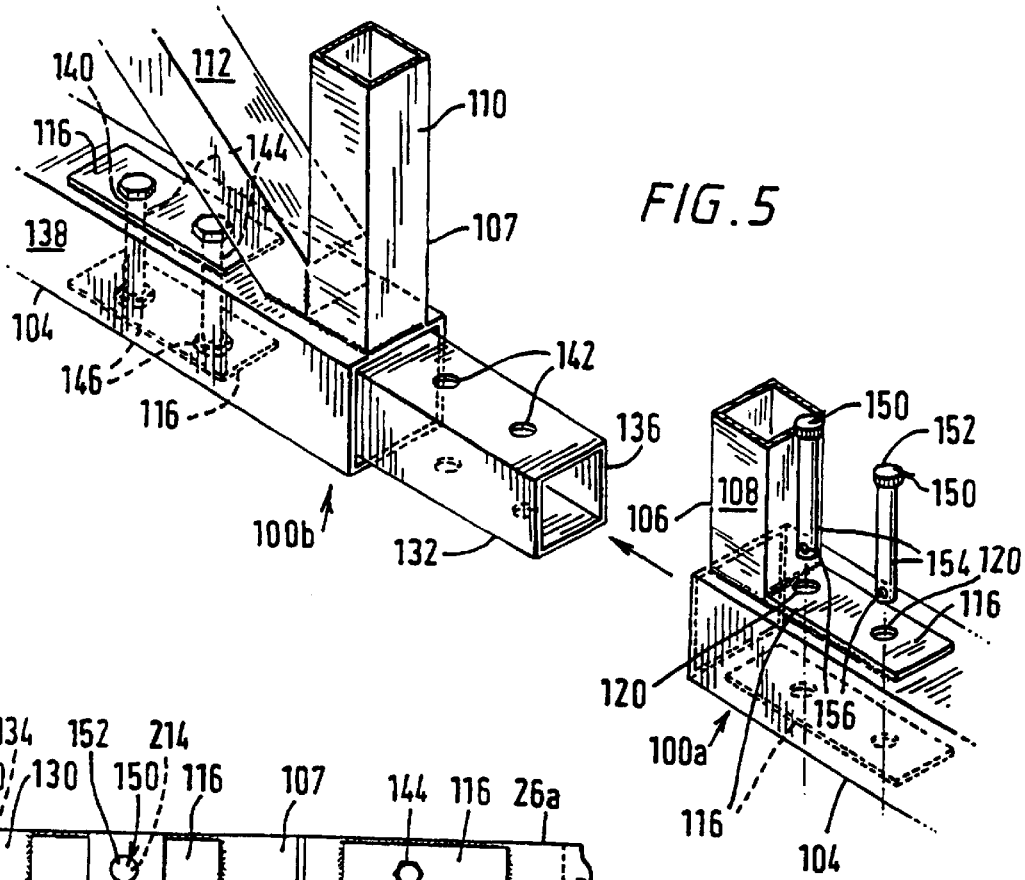
FIG. 5 is an isometric view of a part of the joint of FIG. 4.

As shown in FIGS. 4 and 5, the second end (136) of the first spigot member (130) is entered into the bore (138) defined by the first end (106) of the first chord portion (102) of one of the trusses to be releasably secured (100*a*). The second hole (142) formed in said first spigot member (130) is aligned with the first hole (114) formed in the first chord portion (102), and a bolt (144) is entered through the aligned holes (114,142) and is secured in place by means of a corresponding nut (146).

Similarly, the first end (134) of the second spigot member (132) is entered into the bore (138) defined by the second end (107) of the second chord portion (104) of the other truss to be joined (100*b*) and is secured therein by means of a nut and bolt (144,146) as described above.

The second and first ends (136,134) of the first and second spigot members (130,132) respectively can be left in their corresponding bores (138) permanently.

In order to secure releasably the two trusses (100*a*,100*b*) one to the other, the first and second ends (106,107) of the trusses (100*a*,100*b*) are brought into juxtaposition one with the other; the first end (134) of the first spigot member (130) is entered into the bore (138) defined by the second end (107) of the first chord portion (102) of the other truss (100*b*). Simultaneously, the second end (136) of the second spigot member (132) is entered into the bore (138) defined by first end of the second chord portion (104) of the one truss (100*a*). The first hole (140) formed in the first end (134) of the first spigot member (130) is brought into alignment with the second hole (118) formed in the second end (107) of the first chord portion (102); and the second hole (142) formed in the second end (136) of the second spigot member (132) is brought into aligned with the first hole (120) formed in the first end (106) of the second chord portion (104) of the one truss (100*a*).

In each case, a non-threaded pin (150) is then entered through the aligned apertures (118,140;120,142). Said pin (150) comprises a head portion (152) which abuts on the exterior surface of the corresponding cheek plate (116) and a non-threaded stem portion (154) which extends through the aligned holes (118,140;120,142). Said stem portion (154) is drilled to provide a bore (156) therethrough remote from said head portion (152). In the fitted position, said bore (156) is disposed outside the corresponding chord portion (102;104) and cheek plate (116); a releasable R-clip (158) is entered through the bore (156) to secure releasably the non-threaded pin (150) in the aligned holes (118,140;120, 142).

In this way, each truss (100) is joined to its neighbouring truss(es) (100) at two spaced locations. The use of the non-threaded pins (150) and releasable retaining R-clips (158) facilitates rapid assembly and disassembly of the trusses one from another, and thus of the entire construction (20).

Figure 6:
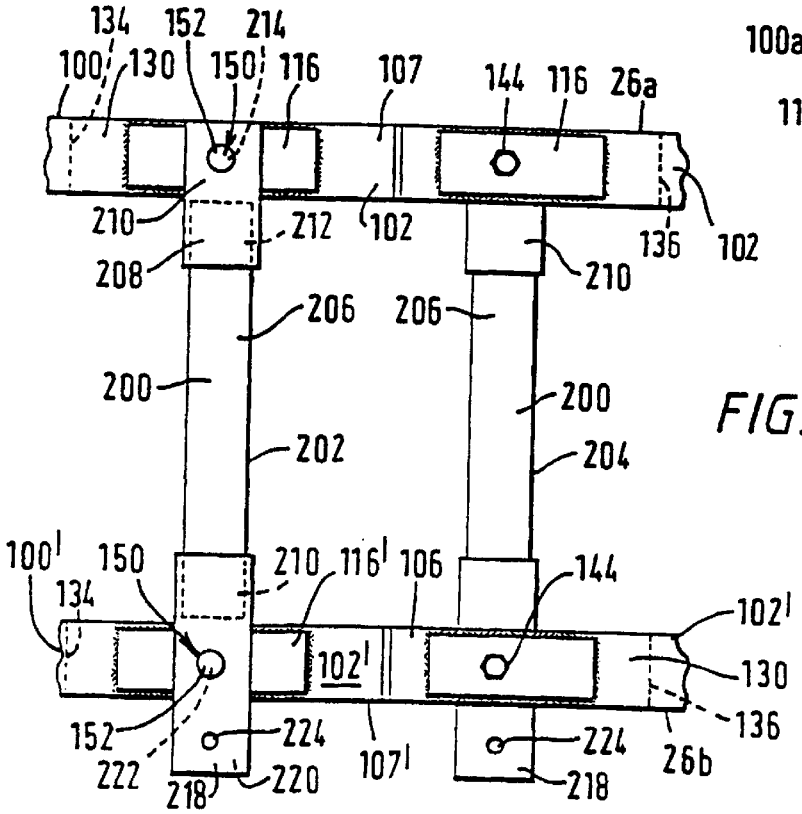
FIG. 6 is an enlarged plan view showing a detail of the simplified stage assembly of FIGS. 1 and 2.

Each truss (100) is also secured releasably to a corresponding truss (100') in its neighbouring row(s) (26) by a plurality of braces (200); in the embodiments of the invention illustrated in FIGS. 2 and 6, each truss (100) is releasably secured to the corresponding truss (100') in the neighbouring row (26) by two such braces (200). A first brace (202) extends between the second end (107) of the first chord portion (102) of one truss (100) and the second end (107') of the first chord portion (102') of the corresponding truss (100') of the neighbouring row (26); a second brace (204) extends between the first end (106) of the second chord portion (104) of the one truss and the first end (106') of the second chord portion (104') of the corresponding truss (100'). For convenience, FIG. 6 shows the first brace (202) which extends between one truss (100) and the corresponding truss (100') in the neighbouring row, and the second brace (204) which extends between the next adjacent pair of corresponding trusses (100,100').

Each of said first and second braces (202,204) which extends between the row (26) juxtaposed the up-stage end (22) of the roof construction (20)—designated as row (26*a*) in FIGS. 2 and 6—and the neighbouring row (26) on the down-stage side—designated as row (26*b*)—comprises an intermediate tube portion (206) having an up-stage end (208) and a down-stage end (210); said intermediate tube portion (206) is constituted by a length of steel tube of generally square or rectangular cross-section.

The up-stage end (208) carries a pair of spaced upper and lower plates (210,212) on its upper and lower surfaces respectively. Each of said plates (210, 212) is welded on the up-stage end (20B) and extends away from said up-stage end (208) in the up-stage direction, as shown in FIG. 6, by distance about equal to the width of the corresponding chord portion (102;104) in the up-stage-down-stage direction transverse the first and second ends (106,107) of the truss (100). Said upper and lower plates (210, 212) define a recess therebetween in juxtaposition with said up-stage end (208), which recess accommodates the corresponding end (106;107) of the corresponding chord portion (102;104) of the truss (100) of the up-stage row (26*a*).

Each of said upper and lower plates (210,212) has a hole formed therein (214) which is aligned with the aligned holes (118,140;120,142) in the corresponding end of the corresponding chord portion and the corresponding end of the corresponding spigot member (130;132). The pin (150) extends through the holes (214) formed in the upper and lower plates (210,212), thereby to secure releasably the up-stage end (208) of the brace (202;204) to the corresponding truss in the up-stage row (26*a*).

The down-stage second end (210) of each of said first and second braces (202,204) also carries a pair of spaced upper and lower plates (218,220). The upper and lower plates (218,220) on the down-stage end (210) of the brace (202;204) differ from the plates (210,212) on the up-stage end (208) in that the plates (218,220) on the down-stage end (210) extend away from the intermediate tube portion (206) in the down-stage direction by distance approximately twice the transverse width of the corresponding chord portion (102';104'); each of said upper and lower plates (218,220) on the down-stage end (210) has two holes formed therein, an up-stage hole (222) and a down-stage hole (224).

The upper and lower plates (218,220) on the down-stage end (210) of the brace (202;204) define a recess therebetween which accommodates the corresponding end (106';107') of the corresponding chord portion (102';104') of the truss (100') of the neighbouring row (26*b*). The up-stage holes (222) are aligned with the aligned holes (118', 140';120',142') in the corresponding end of the corresponding chord portion (102';104') and the corresponding end of the corresponding spigot member (130';132); the non-threaded pin (150') is entered through the up-stage holes (222) to secure releasably the down-stage end (210) of the brace (202;204) to the corresponding truss of the neighbouring row (26*b*).

Thus each truss (100) in each row is releasably secured to a corresponding truss (100') in a neighbouring row to form a box-like structure. The Applicants have found that a construction such as the roof (20) herein described formed in this way from such trusses (100, 100') by releasable joints has a good weight/performance ratio, and can, for a given packed volume of components, be assembled to form a construction having a higher load-bearing capacity as compared with prior art constructions having the same packed volume.

Each truss (100) of the row (26) forming the down-stage end (23) of the roof construction (20)—designated as row (26*d*) in FIG. 2—is joined to its neighbouring row in the up-stage direction—designated row (26*c*)—by means of braces (200) in the same way as between rows (26*a*) and (26*b*).

Neighbouring rows (26*b*) and (26*c*) are secured releasably one to the other by a plurality of braces (300) which are not illustrated in detail. Each of the braces (300) is constituted simply by a length of steel tube of generally square or rectangular section having an up-stage end and a down-stage end, each of which up-stage and down-stage ends has a hole drilled therethrough which extends substantially vertically through the upper and lower walls of the tube. The up-stage end of each brace (300) is accommodated in the recess defined by the upper and lower plates (218,220) on the down-stage end (210) of a corresponding one of the braces (200) which extend between the rows (26*a*) and (26*b*) such that the holes drilled in the up-stage end of the brace (300) are aligned with the holes (224) formed in said upper and lower plates (218,220) of the corresponding brace (200); a non-threaded pin of the kind hereinbefore described is entered through the aligned holes to secure releasably the up-stage end of the brace (300) between the upper and lower plates (218,220) of the corresponding brace (200). The down-stage end of the brace (300) is secured releasably in similar fashion between the upper and lower plates (218, 220) of a corresponding one of the braces (200) which extend between the rows (26*d*) and (26*c*).

Each tower (30) comprises two spaced, upright columns (34). As shown in FIGS. 1 and 2 each column is constituted by two trusses (100) secured releasably one to another by means of releasable joints as hereinbefore described. It will be understood however that more than two columns can be employed if desired. Of course, each tower truss (100) is oriented such that the first and second chord portions (102, 104) are disposed substantially vertically. Each tower may be assembled for use in a reclined position on the ground and then erected to the position shown in FIG. 1 by lifting the upper extremity of the tower to rotate the tower through 90°. Alternatively, the tower may include a pivot means as hereinafter described.

Figure 7:
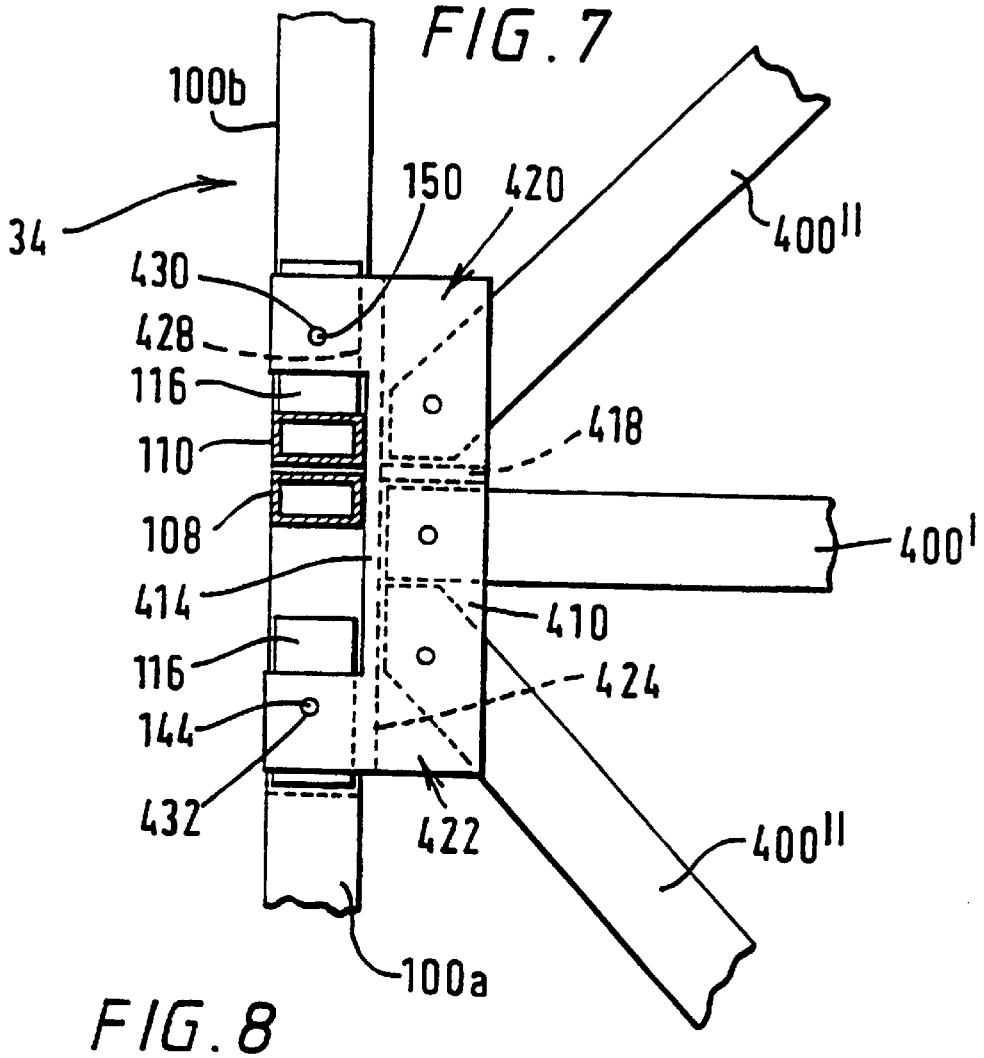
FIG. 7 is a side view of another releasable joint for a tower according to the invention.

Each of the upright columns (34) is secured releasably to the other column by a plurality of braces (400) as shown in FIGS. 2 and 7. In the example shown in FIG. 7, the ends of three braces (400)—one horizontal brace (400') and two—diagonal braces (400")—are releasably secured in juxtaposition with two neighbouring trusses (100*a*,100*b*) in one of the columns (34); the other ends (not shown) of the three braces (400) are secured releasably to a corresponding pair of neighbouring trusses (100') in the other column (34').

Figure 8:
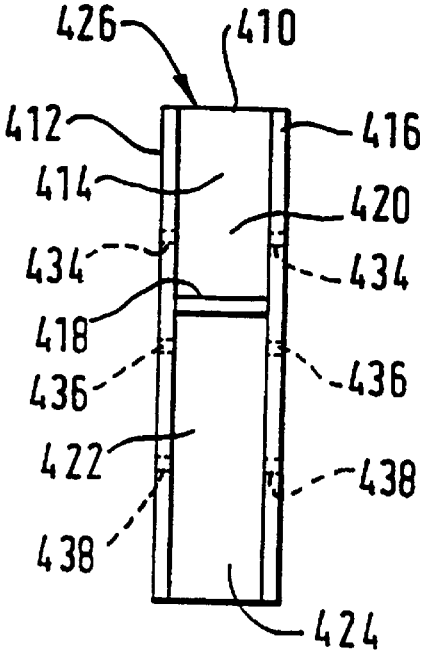
FIG. 8 is a side elevation of a tower bracket member.

The ends of the braces (400) are secured releasably to the neighbouring trusses (100) by means of a tower bracket member (410) as shown in FIGS. 7 and 8. Said tower bracket member (410) comprises three substantially vertically disposed plates (412,414,416) which are secured fixedly to one another to form a structure which is H-shaped in cross-section; the tower bracket (410) further includes a horizontally disposed plate (418) which is welded to each of the vertically disposed plates (412,414,416) to provided an internal abutment and two vertically spaced upper and lower recesses (420,422) respectively in juxtaposition with one surface (424) of the middle plate (414) of the H-shape. The bracket member (410) defines a vertically disposed channel (426) in juxtaposition with the other surface (428) of the middle plate (414). One of the outer plates (412) of the H-shape is cut out as shown in FIG. 7 in juxtaposition with the vertically disposed channel (426) in order to accommodate the juxtaposed first and second transverse brace portions (108,110) respectively of the neighbouring trusses (100*a*,100*b*) of the one column (34). Both outer plates (412,416) are drilled as shown in FIG. 7 to provide first and second holes (430,432) aligned respectively with the non-threaded pin (150) which extends through the corresponding end of the corresponding chord portion (102;104) of one of the neighbouring trusses (100*b*) and the bolt (144) which extends through the corresponding end of the corresponding chord portion (102;104) of the other neighbouring truss (100*a*). The non-threaded pin (150) and bolt (144) pass through the respective holes (430,432) to secure the bracket member releasably to the one truss (100*b*) and semi-permanently to the other truss (100*a*), with the said other surface (428) of the middle plate (414) disposed contiguous the juxtaposed surfaces of the chord portions (102,102;104, 104;) of the neighbouring trusses (100*a*,100*b*).

The outer plates (412,416) are also drilled as shown in FIGS. 7 and 8 to provide vertically spaced holes (434,436, 438) aligned with corresponding holes formed in the ends of the three braces (400) for releasably securing the ends of the braces (400) in the upper and lower recesses (420,422) as shown in FIG. 7, by means of non-threaded pins (not shown) of the type hereinbefore described.

Figure 9:
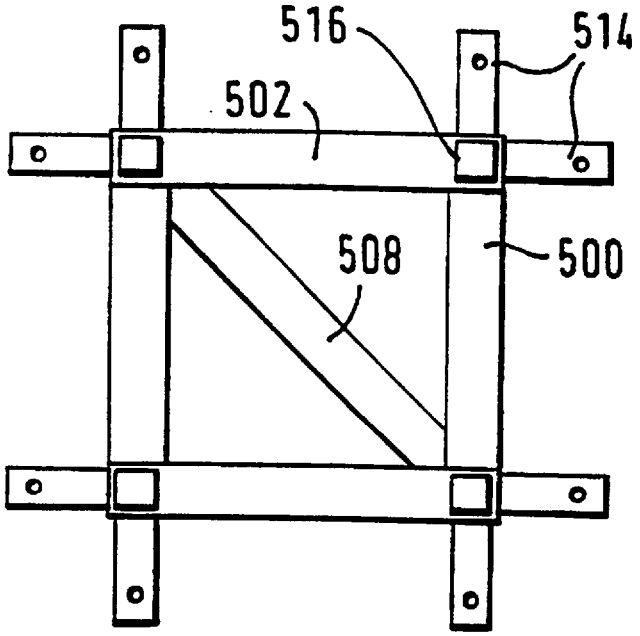
FIG. 9 is a plan view of a tower base member in accordance with the present invention.
Figure 10:
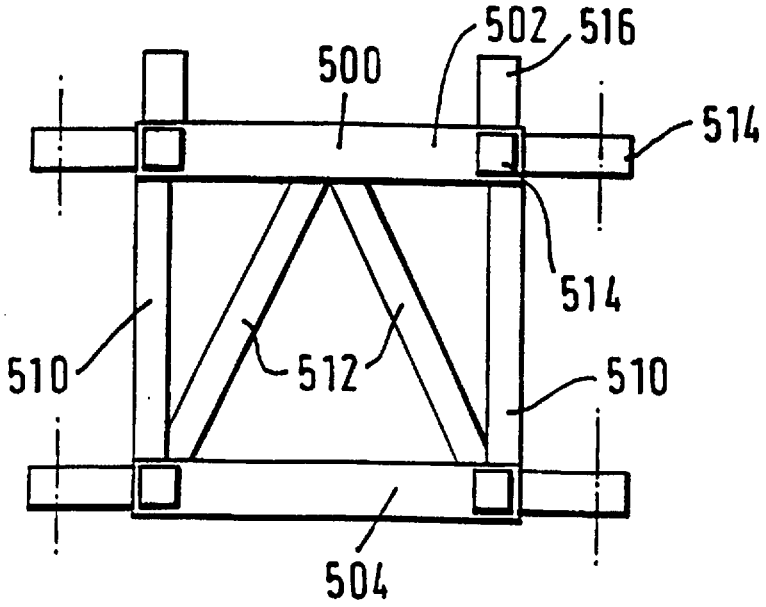
FIG. 10 is a side elevation of the tower base member of FIG. 8.

Each tower base (40) comprises a central landing base (500) as shown in FIGS. 9 and 10 which comprises two vertically spaced upper and lower frames (502,504). Each of said upper and lower frames (502,504) is constituted principally by four lengths of steel tube of square or rectangular cross-section which are secured fixedly one to one another in a substantially square configuration as shown in FIG. 9. Each of the upper and lower frames (502,504) is reinforced by a diagonal brace (508) (see FIG. 9) which is welded to and extends between diametrically opposed corners of the square frame (502;504).

The upper and lower frames (502,504) are interconnected at their corners by four substantially vertically disposed braces (510) and by eight diagonal braces (512).

At each corner, the upper frame (502) carries two substantially horizontally disposed, mutually orthogonal "starter spigots" (514) and one substantially vertically disposed "starter spigot" (516).

Each of the columns (34) of a corresponding tower (30) is releasably secured at its lower extremity (33) to the landing base (500) by means of a respective pair of the vertically disposed starter spigots (516) which are drilled to provide holes which can be aligned with the holes formed in the mating ends of the chord portions (102,104) of the corresponding column (34), in order to allow the column (34) to be secured releasably to the landing base (500) by means of non-threaded pins (not shown) as hereinbefore described.

The horizontally disposed starter spigots (514) are also drilled as shown in FIGS. 9 and 10 for connection to outwardly extending trusses (100) as shown in FIG. 1 to provide a generally eruciform base of sufficiently large area for supporting the tower (30). Each of the outwardly extending trusses (100) is secured releasably to the landing base (500) by a releasable joint in the manner described above.

If further ballast is required in the tower bases (40), water bags or tanks can be attached to the tower bases and filled with water in situ to provide an additional stabilizing mass at the bases of the towers (30).

Figure 11:
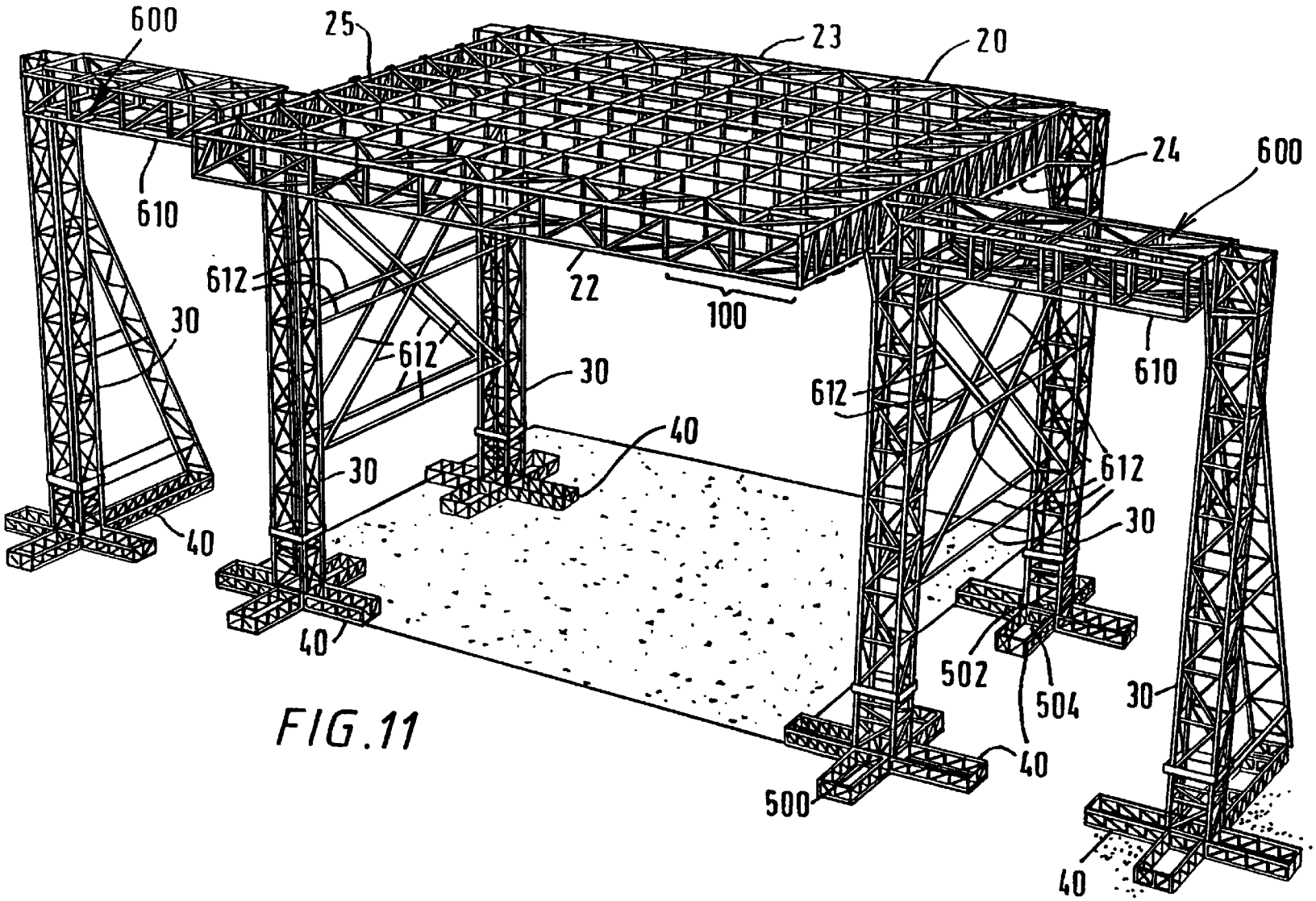
FIG. 11 is an isometric view of an actual stage assembly in accordance with the invention.
Figure 12:
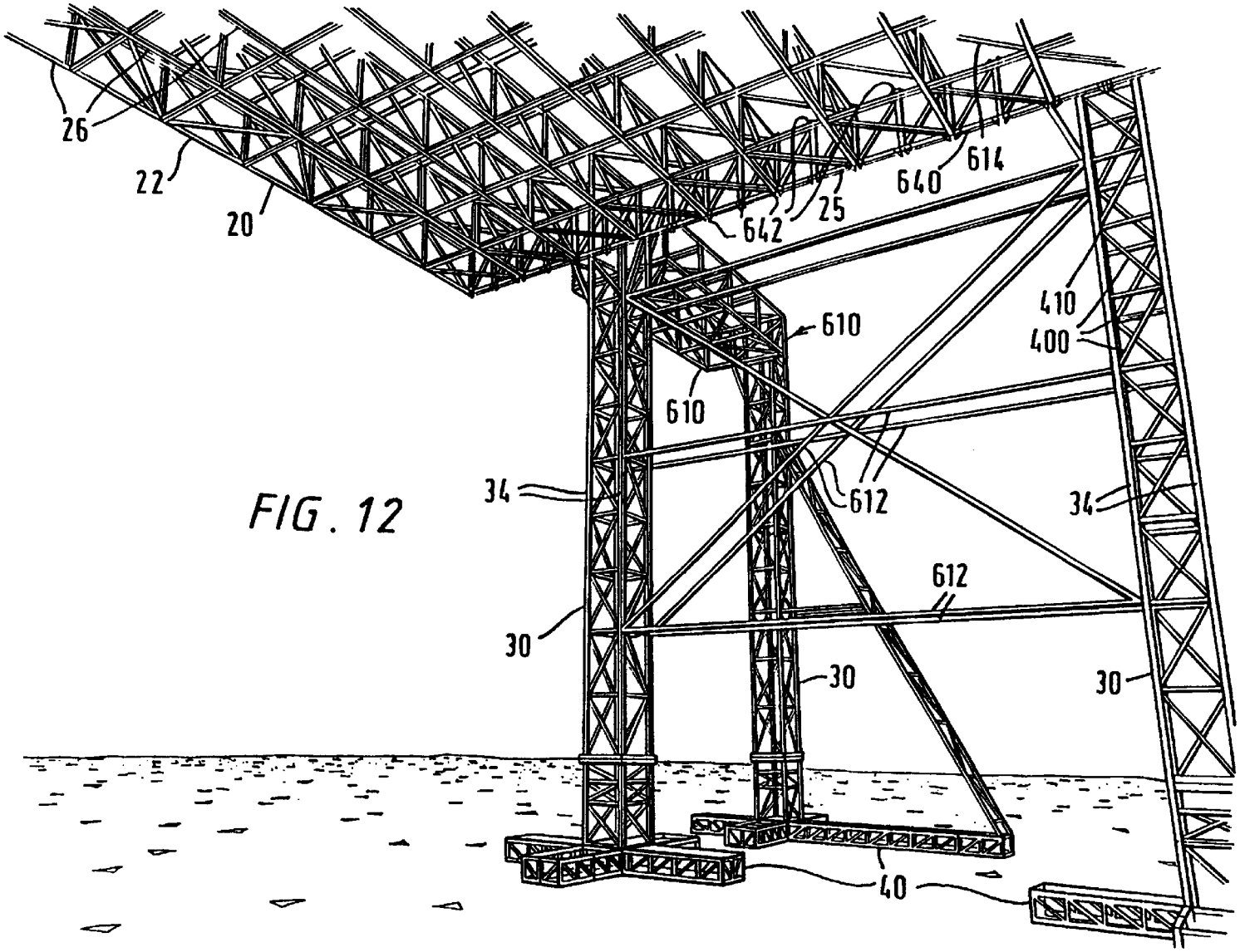
FIG. 12 is an isometric view of a part of the actual stage assembly of FIG. 11, showing a part of a roof and three towers.

Having described a simplified embodiment of a construction in accordance with the present invention, FIGS. 11 and 12 show, as another example, an actual stage assembly in this case comprises a roof (20) which is supported by four upstanding towers (30). It will be seen that the principle of construction of the roof (20) and towers (30) is the same as for the simplified embodiment hereinbefore described; the roof (20) and towers (30) are constructed in the main from a plurality of trusses (100) which are secured releasably one to another by means of a releasable joint as herein described.

The embodiment illustrated in FIGS. 11 and 12 additionally comprises two "outrigger" assemblies (600) juxtaposed the side margins (24,25) of the roof (20). Each out rigger assembly (600) includes a beam (610) which is carried by one of the towers (30) supporting the roof (20) and an additional tower (30) spaced from the one tower in the cross-stage direction. The additional tower (30) is of substantially the same construction as each of the towers (30) supporting the roof (20); the beam (610) is also made up from trusses (100) in the same way as the roof (20) which are joined one to another end-to-end and in rows which are interconnected by braces as described above. The beams (610) can be used for supporting additional equipment for use during e.g. a concert.

It will also be noted that the towers (30) on either side (24,25) of the roof (20) are interconnected by a plurality of stays (612) for reinforcement. Conveniently, the ends of the stays (612) can each be connected to a juxtaposed releasable joint between two trusses (100) by means of the non-threaded pin (150) forming part of the joint.

Figure 13:
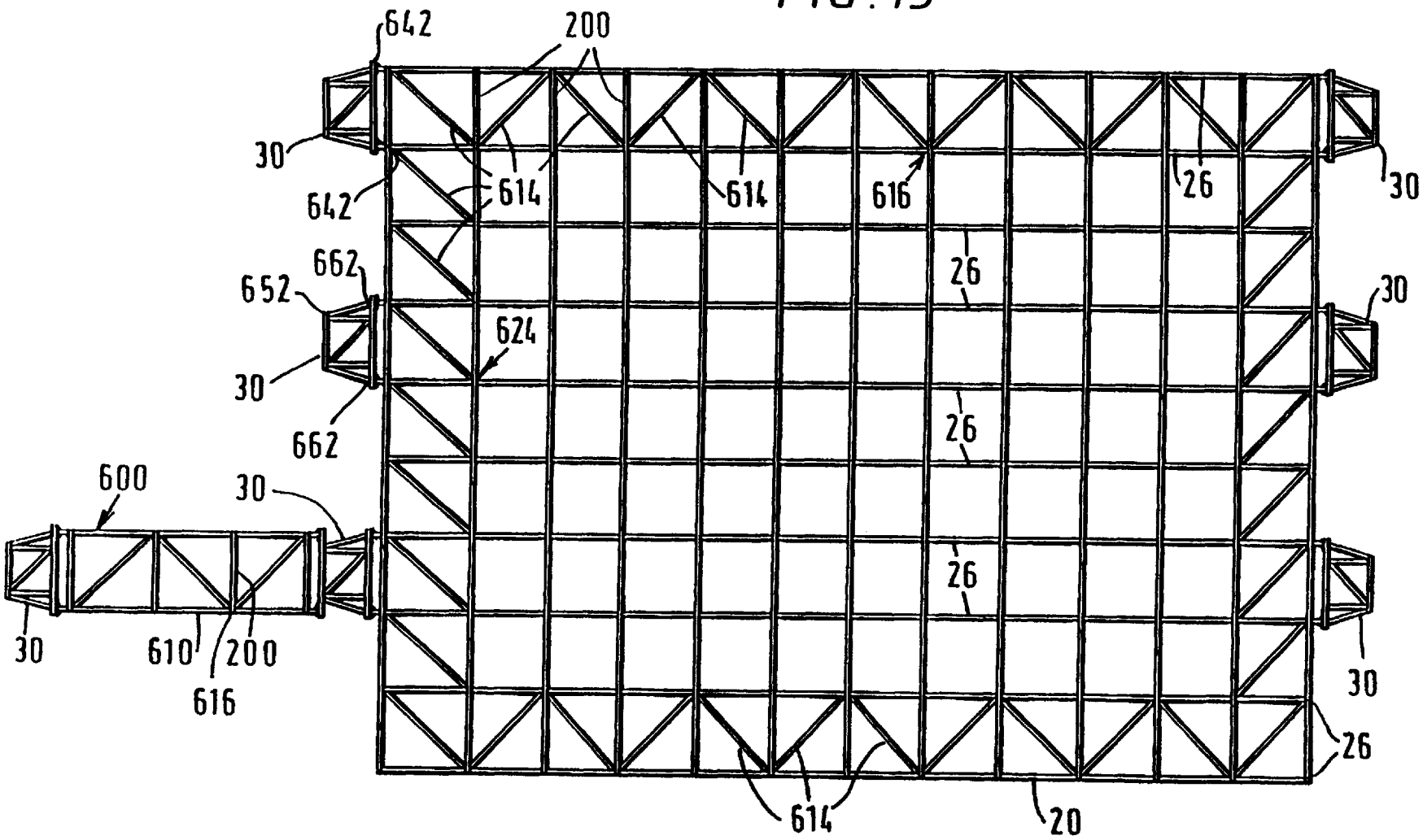
FIG. 13 is a plan view of another actual stage assembly in accordance with the present invention.
Figure 16:
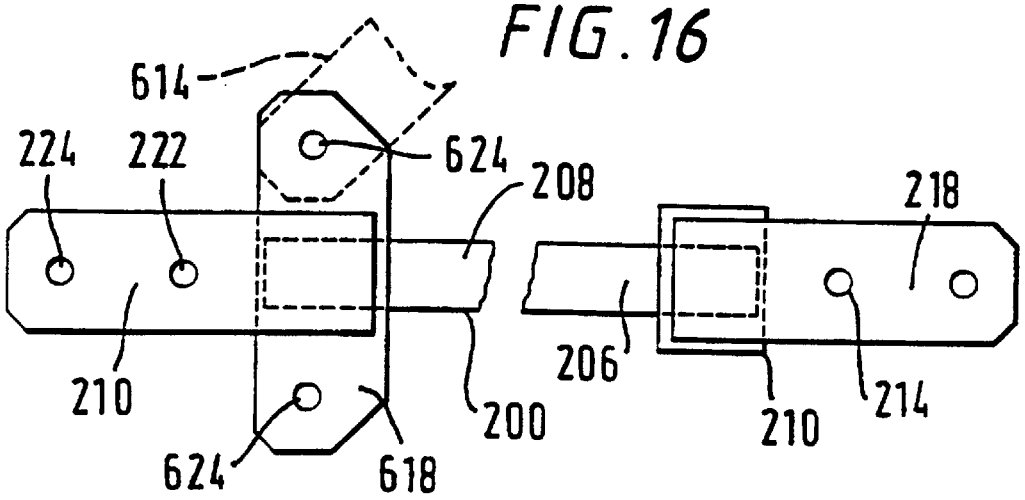
FIG. 16 is a plan view of a brace member.
Figure 17:
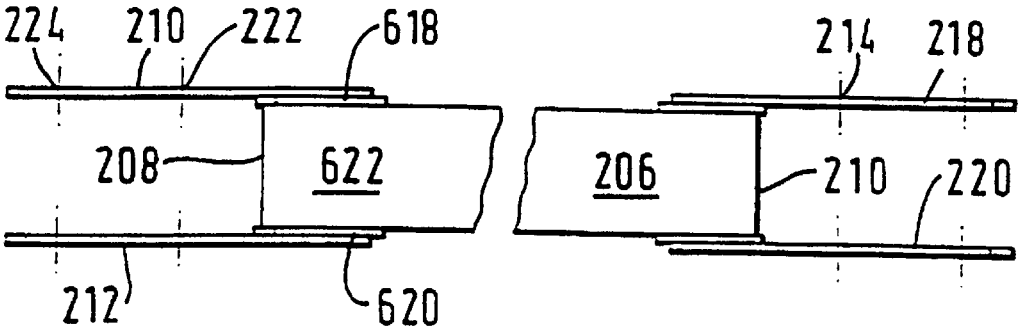
FIG. 17 is a side view of the brace member of FIG. 16.

FIG. 13 shows a six tower construction in which the roof (30) includes additional diagonal brace members (614) between neighbouring rows (26) of trusses (100) around the periphery of the roof (20). For this purpose, the braces (200) extending between neighbouring rows (26) in juxtaposition with the roof periphery as described above are modified to include additional bracket portions for mounting the diagonal brace members (614). An example of a modified brace (200) for use in securing the juxtaposed ends of two diagonal brace members (614) at points such for example as that illustrated at (616) in FIG. 13 is illustrated in FIGS. 16 and 17. The modified brace (200) includes an intermediate tubular member (206) and upper and lower plates (210,212, 218,220) on the up-stage and down-stage ends (208,210) of the brace (200) in the same way as the unmodified braces (200) shown in FIG. 6. Additionally however the up-stage end (208) of the brace (200) carries upper and lower laterally extending plates (618,620) which define two recesses (622) one in juxtaposition with each cross-stage side of the brace (200). The laterally extending plates (618,620) are drilled to provide holes (624) in the same way as the upper and lower plates (210,212,218,220) on the up-stage and down-stage ends (208,210) of the brace (200), and each of the recesses (622) accommodates an end of one of the diagonal brace members (614) which is drilled in alignment with the holes (624) and is secured releasably in the recess (622) by means of a non-threaded pin (150) of the kind described above.

The other diagonal brace members (614) around the periphery of the roof (20) are also secured releasably to juxtaposed brace members (200) which are modified in an analagus manner to the modified brace member of FIGS. 16 and 17. For instance, laterally extending plates (618,620) will only be required to one cross stage side of a brace member (200) as for example at the point indicated at (624) in FIG. 13.

Figure 14:
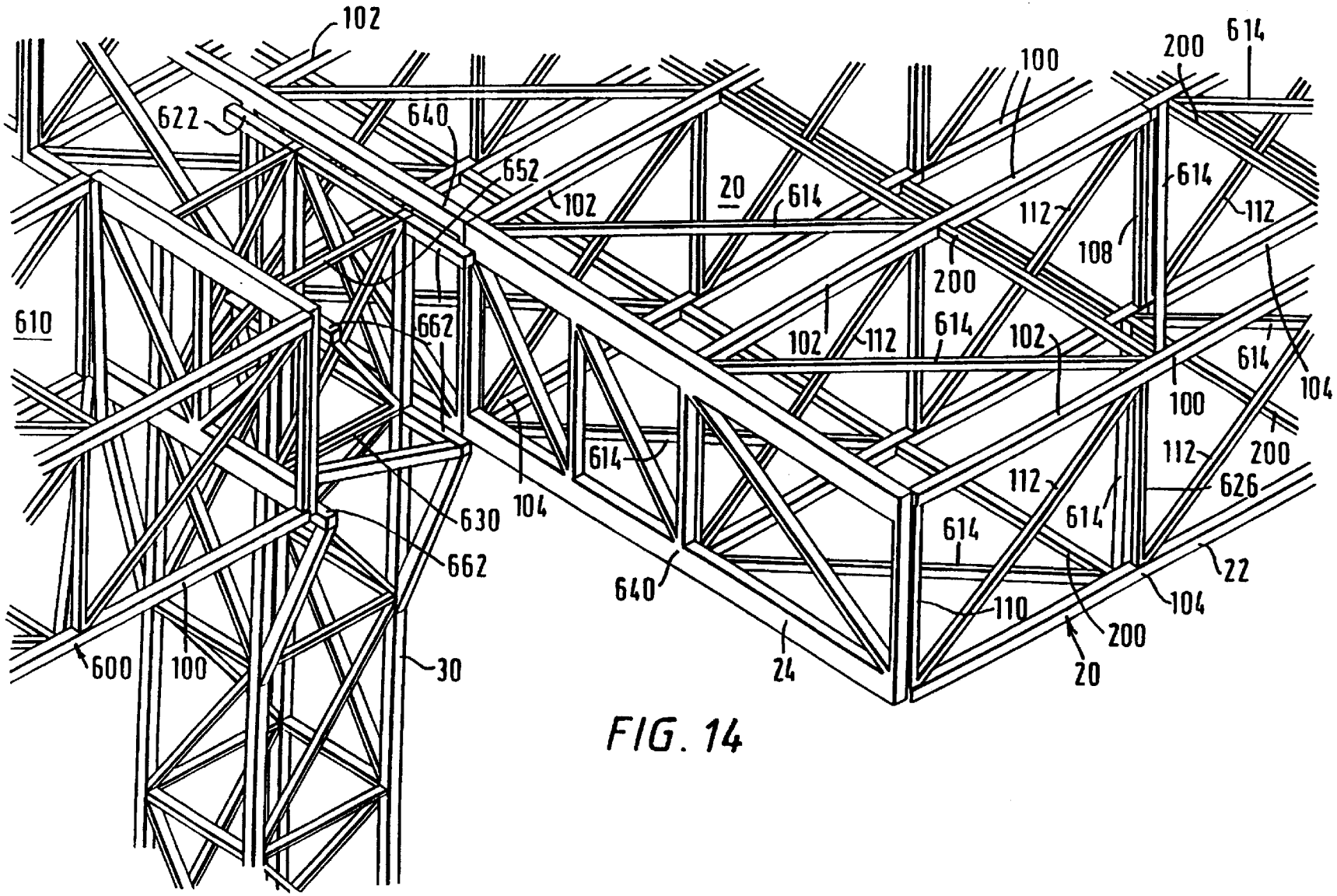
FIG. 14 is an isometric view of a part of the other stage assembly of FIG. 13.
Figure 15:
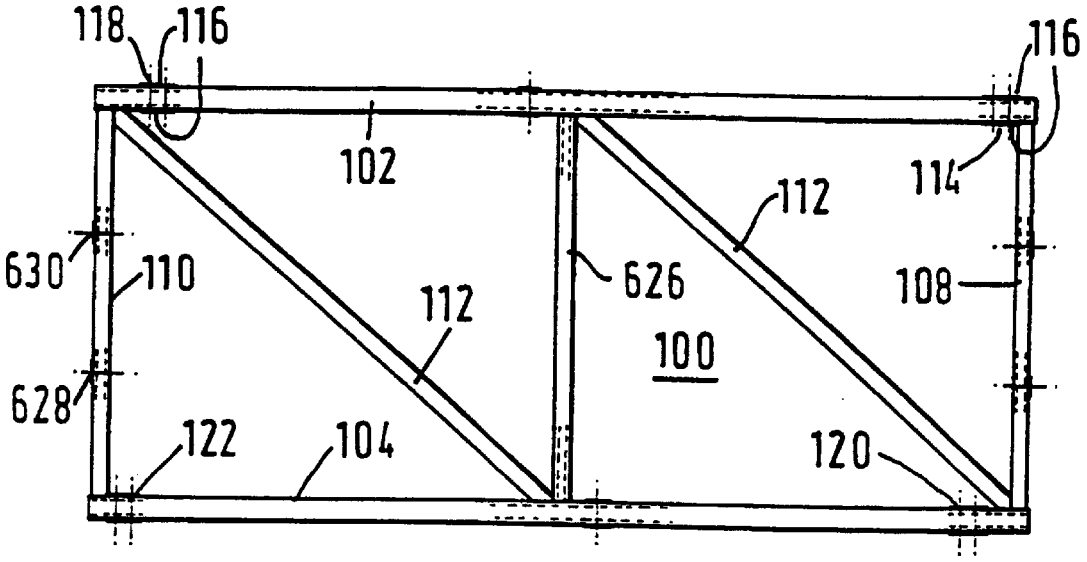
FIG. 15 is a side elevation of a truss in accordance with the invention.

The construction of the rooves (20) of the stage assemblies shown in FIGS. 11 and 12 and FIG. 13 is shown in more detail in FIG. 14. The roof (20) is formed from a plurality of trusses (100) of the kind shown in FIG. 15 comprising first and second chord portions (102,104), first and second transverse end brace portions (108,110), cheek plates (116) and holes (114,118,120,192) in the same way as the truss (100) shown in FIG. 3. As compared with truss (100) of FIG. 3, however the truss (100) of FIG. 15 constitutes a "double" truss in that it comprises an intermediate transverse brace portion (626) and two diagonal brace portions (112) as shown in FIG. 15. The first and second transverse end brace portions (108,110) are also provided each with two vertically spaced holes (628) and associated cheek plates (630), such that in addition to the releasable "pin and spigot" joint as hereinbefore described, each truss (100) can be secured releasably to its neighbouring truss(es) by means of non-threaded pins (150) inserted through the holes (628) in the juxtaposed ends (106,107) of the neighbouring trusses.

Figure 18:
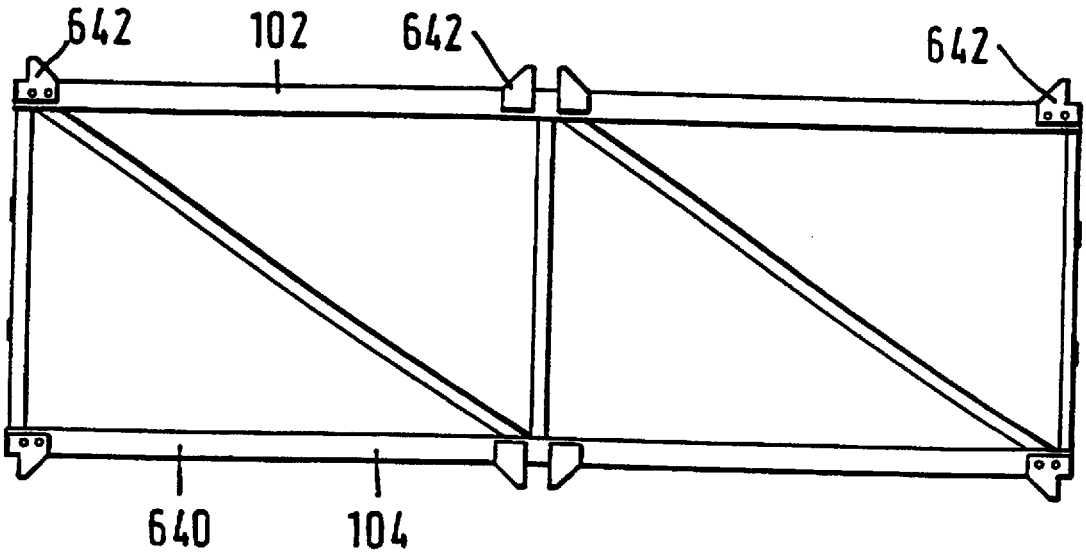
FIG. 18 is a side view of a pick-up truss in accordance with the invention.

With reference to FIG. 14, the sides (24,25) of the roof (20) are formed each by a plurality of pick-up trusses (640) of the kind illustrated in FIG. 18. The design of each pick-up truss (640) is substantially the same as the "double" truss of FIG. 15, and each pick-up truss (640) is joined releasably to a neighbouring pick-up truss(es) (640) by means of a releasable joint of the kind described herein, save in that the non-threaded pins (150) pass through the walls of the upper and lower chord portions (102,104) and through the interconnecting spigots (130) in the cross-stage direction between the two sides (24,25) of the roof (20), rather than vertically as shown in FIGS. 4 and 5. Furthermore, each of the upper and lower chord portions (102,104) is provided with three spaced catch members (624) which are formed by shaped metal plates welded onto the upper and lower chord portions (102,104) as shown in FIG. 18. The spacing between the catch members (642) in the upstage-down-stage direction is the same as the inter-row spacing of the roof (20), and each catch member (642) receives the end of a spigot (130) projecting from the end-most truss (100) of a respective row (26). The end of the spigot (130) is secured releasably between the plates of the catch member (642) by means of a non-threaded pin of the kind described above which passes through holes drilled through the catch member (642) and the end of the spigot (130).

Figure 19:
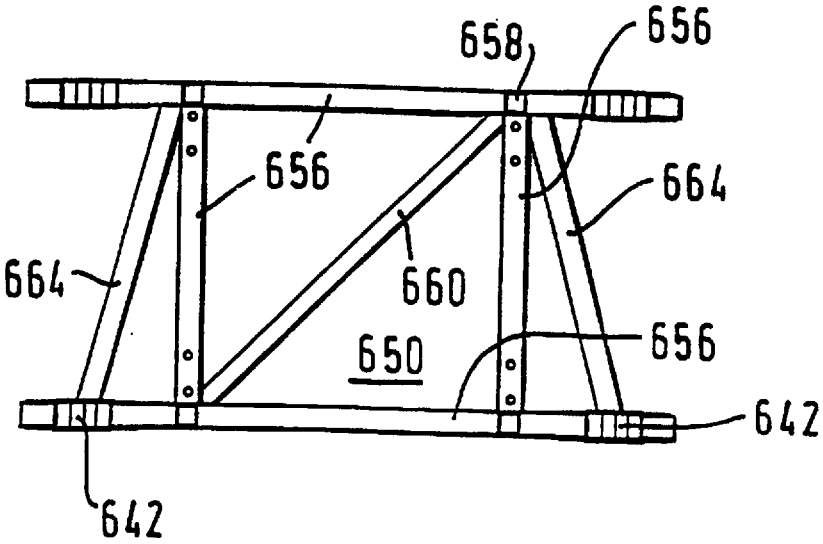
FIG. 19 is a plan view of a roof-lower landing frame.
Figure 20:
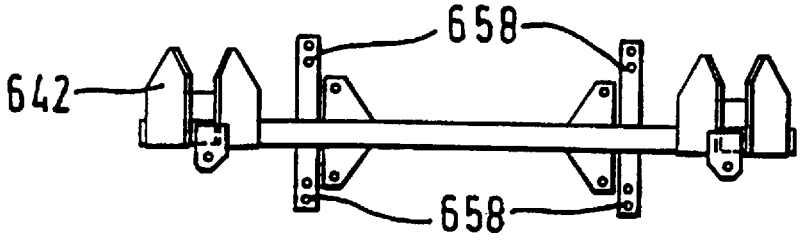
FIG. 20 is a side elevation of the roof lower landing frame of FIG. 19.
Figure 21:
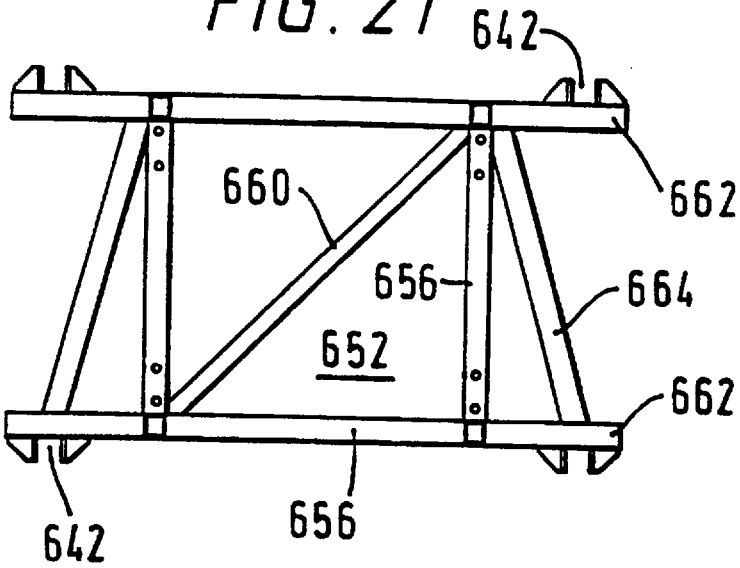
FIG. 21 is a plan view of a roof upper landing frame.
Figure 22:
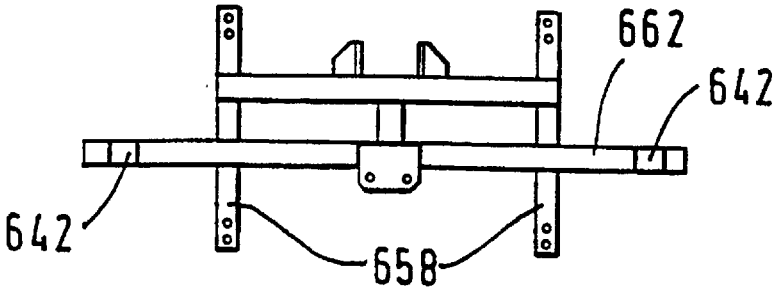
FIG. 22 is a side view of the roof upper landing frame of FIG. 21.

The roof (20) is connected to each of the towers (30) in the embodiments shown in FIGS. 11 and 12 and FIG. 13 by means of a roof lower landing frame (650) as shown FIG. 19 and 20 and a roof upper landing frame (652) as illustrated in FIGS. 21 and 22. The roof lower landing frame (650) is formed from four main tubular elements (4,5,6) formed into a square as shown in FIG. 19. At each corner of the square, the lower landing frame (650) is provided with up-standing and depending starter spigots (658) to mate with neighbouring trusses (100) disposed above and below the lower landing frame (650) by means of releasable joints as herein described. The square is reinforced by means of a diagonal brace (660). Two of the tubular elements (656) forming opposite sides of the square which extend in the up-stage-down-stage direction extend beyond the square to form projecting arms (662). Each of the arms (662) carries a catch member (642) formed from shaped metal plate welded onto the arms (662) of the kind included in the pick-up trusses (640) described above. The projecting arms (662) are reinforced by bracing limbs (664) as shown in FIG. 19.

The roof lower landing frame (650) is carried by cured on two trusses (100) and carries two further trusses (100) above the roof lower landing frame (650). These latter trusses (100) carry the roof upper landing frame (652) thereon. The roof upper land frame (652) as illustrated in FIGS. 21 and 22 is constructed similarly to the roof lower landing frame (650) and is secured releasably to the trusses (100) below it by depending starter spigot (658). The projecting arms (662) of the roof upper landing frame (652) include side mounted catch members (642) however, while in the roof lower landing frame (650) the catch members (642) are mounted on upper surfaces of the projecting arms (662). In each case the catch members (642) on the projecting arms (662) juxtaposed the sides (24,25) of the roof (20) receive the ends of the spigots (130) projecting from the end most trusses (100) at the extremities of the rows (26). The ends of the projecting spigots are secured in the catch members (642) by means of non-threaded pins (150) to form releasable joints of the kind described above. The load of the roof (20) is therefore carried on the projecting arms (662) of the roof lower landing frame, and the coupling between the roof upper landing frame (652) and the upper chord portions (102) of the end most trusses of the rows (26) form a cantilever with the connection between the chord portions (104) and the lower landing frame (650).

From FIGS. 11 and 13, it will be seen that the upper and lower landing frames (650,652) of the towers which do not carry an out river assembly (600) include only two projecting arms (662) in juxtaposition with the sides (24,25) of the roof (20). The upper and lower landing frames (650,652) of FIGS. 19 to 22 are suitable for use for towers (30) which carry an out rigour assembly (600) such, for example, as that shown in FIG. 14. The catch members (642) on the projecting arms (662) remote from the sides (24,25) of the roof (20) of the upper and lower landing frame (650,652) can be used to form a cantilever coupling with projecting spigot members (130) projecting from the extremities of the trusses (100) constituting the beam (610) of the out rigour (600).

Figure 23:
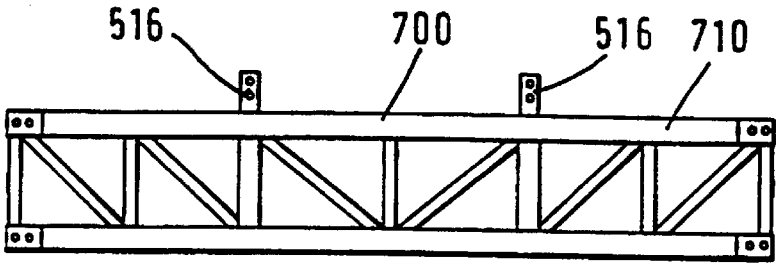
FIG. 23 is a side view of a tower landing base.
Figure 24:
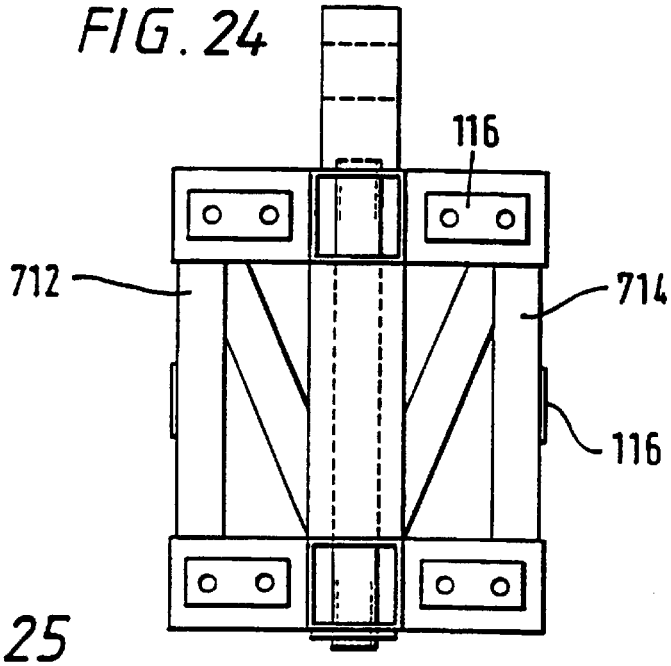
FIG. 24 is a side view of the tower landing base of FIG. 23, partly in cross-section on the line A—A.
Figure 25:
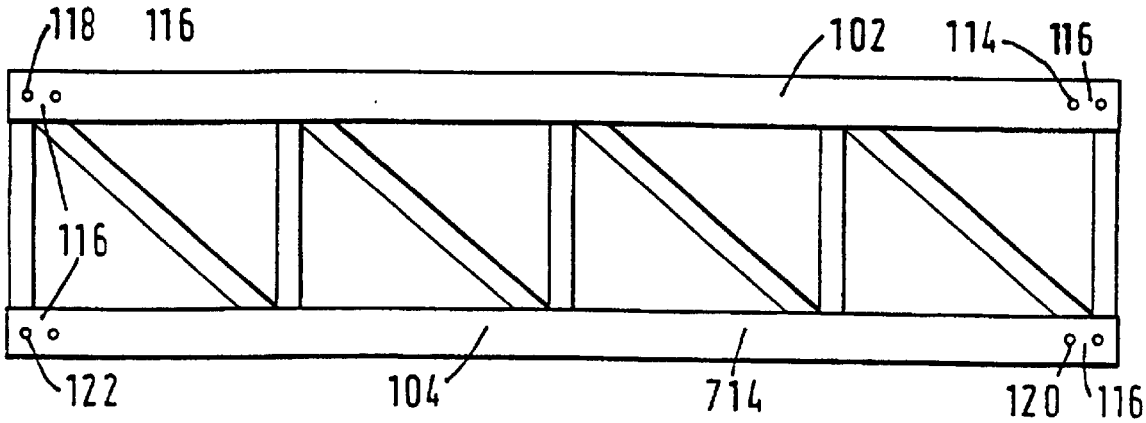
FIG. 25 is a side view of an extension truss for the tower landing base of FIGS. 23 and 24.
Figure 26:
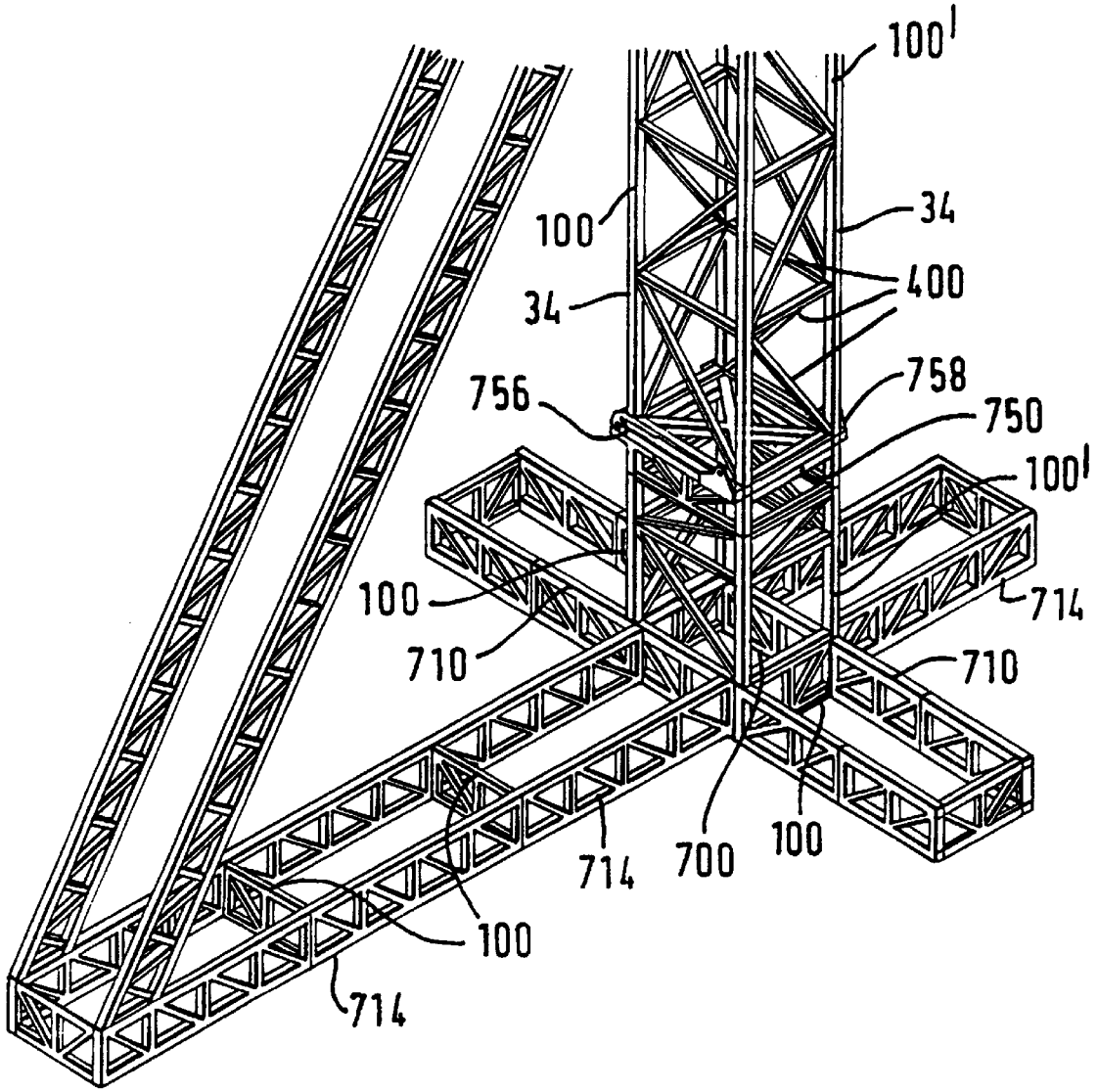
FIG. 26 is an isometric view of part of a tower including a pivot unit in accordance with the present invention.

As described above with reference to FIGS. 9 and 10, each of the towers (30) of the simplified stage assembly is supported on tower landing base (500). In the examples illustrated in FIGS. 11 and 12 and FIG. 13 a more sophisticated tower landing base (700) is employed as shown in FIGS. (23,24,25,26). With reference first to FIGS. 23 and 26, each tower landing base (700) includes two-spaced parallel tower base trusses (710), each of which includes two-spaced upstanding starter spigots (516) for mating with the lower trusses (100) of the tower (30). The two tower base trusses (710) are oriented in use in the cross-stage direction as shown in FIG. 26 and, in juxtaposition with each starter spigot (516), each of the tower base trusses (710) is provided with two short projecting truss portions (712) which extend in the up-stage-down-stage direction. In the assemble position, one of each pair of short projecting truss portions (712) associated with a given starter spigot (516) is directed towards a respective short projective truss portion (712) on the other tower base truss (710). These are secured together through a short truss (100) in the up-stage-down-stage direction using releasable joints of the invention. The remaining one projecting truss portions (712) of each pair projects outwardly of the tower landing base and can be connected to an extension truss (714) as shown in FIG. 25 as required. With reference to FIG. 26, juxtaposed extension trusses (714) can be coupled together at spaced locations using short trusses (100).

As described above, the tower landing base (700) carries two columns (34) of trusses (100), the two columns being secured releasably one the other by braces (400).

Figure 27:
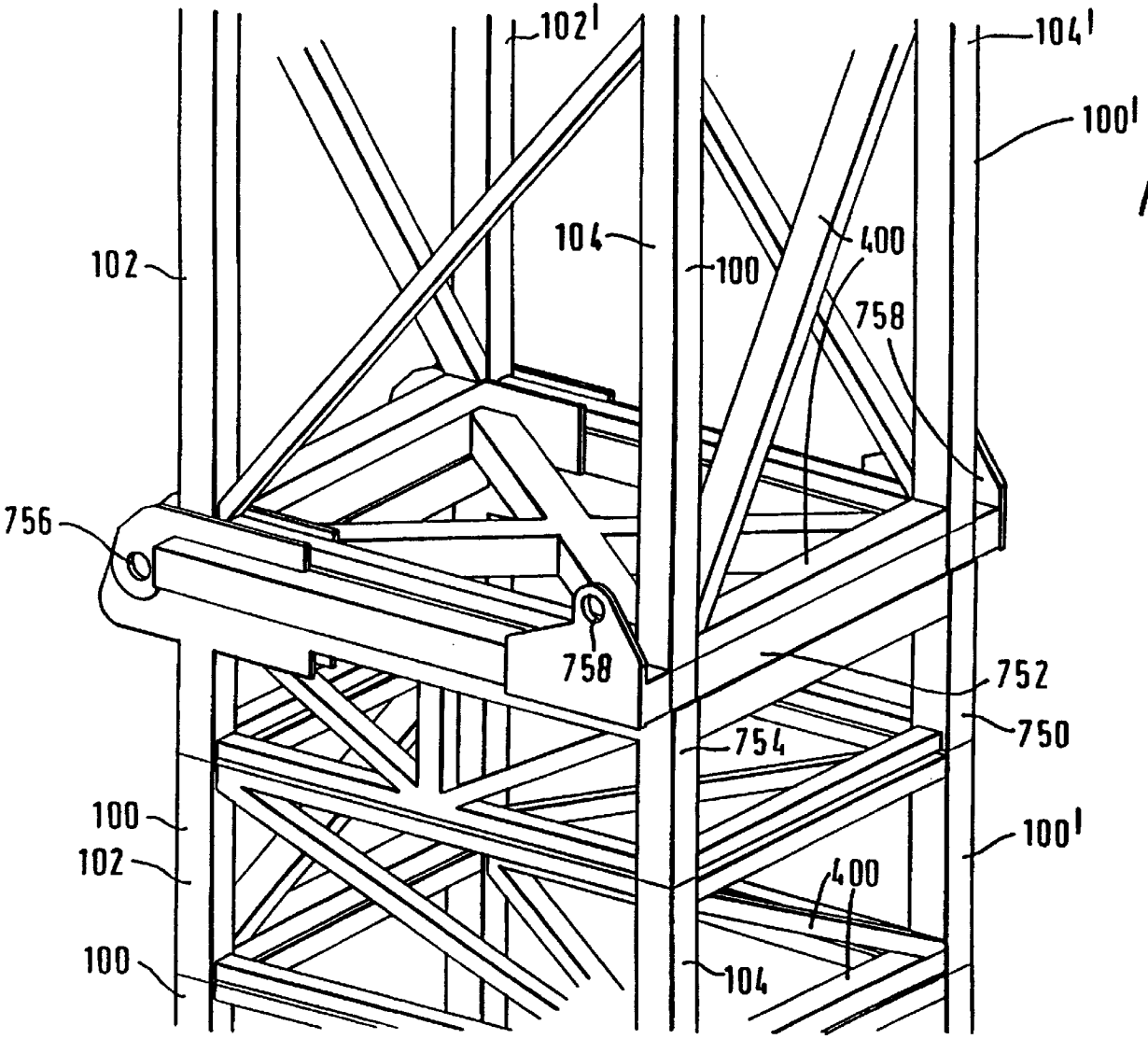
FIG. 27 is an isometric view of a part of the tower of FIG. 26 showing detail of the pivot unit.

In the embodiments shown in FIGS. 26 and 27 of the drawings, intermediately second and third trusses (100) counting up from the tower landing base (700) goes interposed a pivot unit (750). Said pivot unit (750) comprises a upper and lower landing portions (752,754) which are secured fixedly one to the other through a pivot (756), the axis of which extends horizontally along one side of the pivot unit (750). Each of the upper and lower landing portions (752,754) is provided with starter spigots (not shown) for connecting to the trusses (100) disposed above and below the pivot unit (750). The pivot unit (750) further comprises locking means (not shown) for locking the pivot unit in a closed position as shown in Figures (26,27). The upper landing portion of the pivot unit (750) includes two spaced couplings (758) for coupling the upper landing portion (752) to two spaced pistons (not shown) each driven by a hydraulic ram.

The lower part of the tower (30) will be constructed manually in situ to a height which is convenient and safe for a work force working on or near the ground. The pivot unit (750) will then be mounted on the lower part of the tower in an open position. The upper part of the tower above the pivot unit will then be built in a reclined position connected to the upper landing portion (752) of the pivot unit (750). The hydraulic rams can then be connected to the couplings (758) and operated to lift the upper part of the tower (30) to the erected position.

Conveniently, the hydraulic rams can be provided on a transportable dolly having carriage means adapted for translation movement over the ground, such that the hydraulic ram can be moved from one tower to another for erecting each tower in turn.

Figure 28:
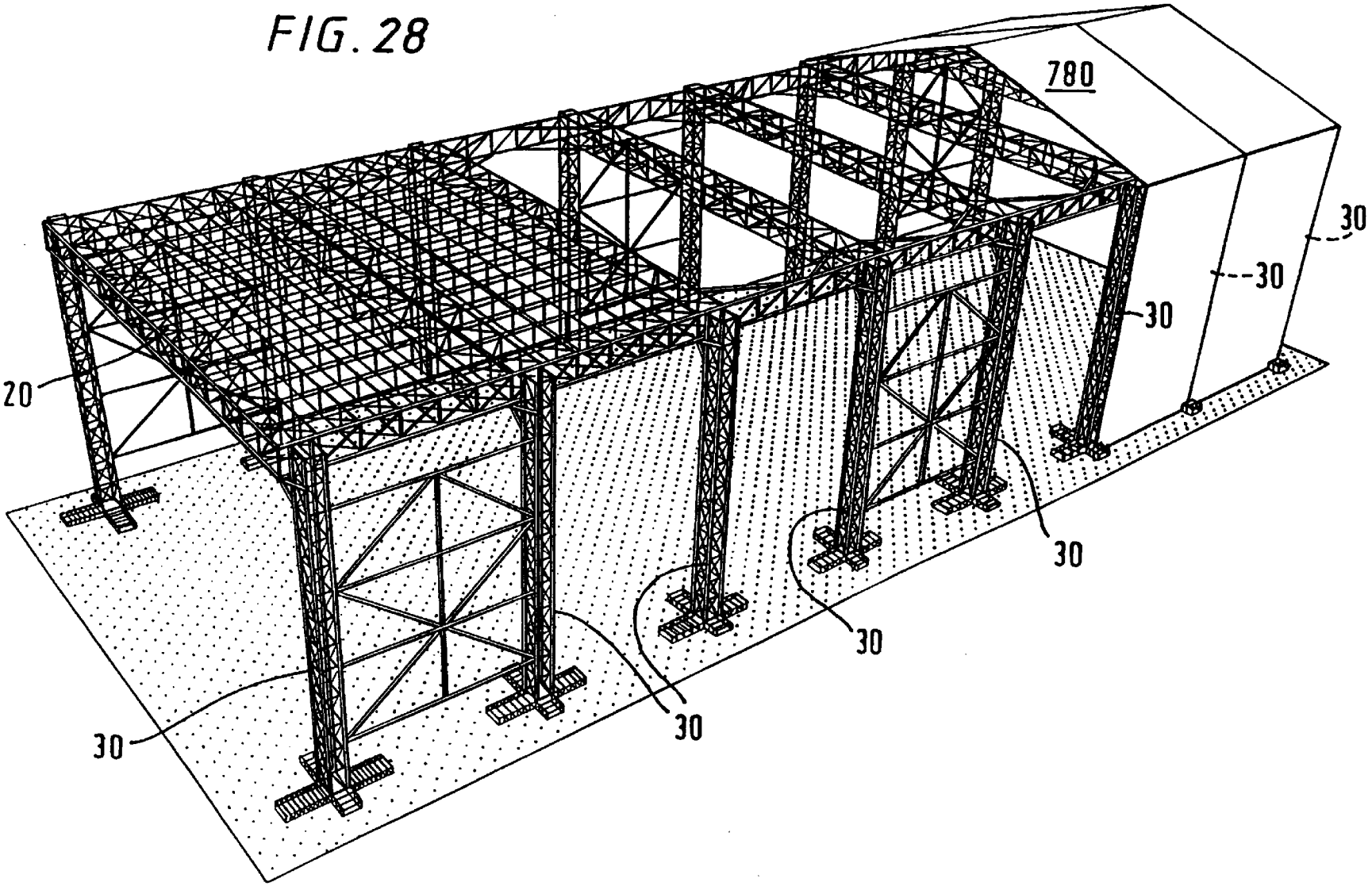
FIG. 28 is an isometric view of a transportable building in accordance with the present invention.

As mentioned above, in addition to stage assemblies of the kind hereinbefore described, the construction of the present invention may be a transportable building such for example, as that illustrated in FIG. 28. The building of FIG. 28 comprises 16 towers (30) and a roof (20) of the kind hereinbefore described carried by three pairs of towers (30) at one end of the building. The remaining five pairs of towers are joined to the roof and to each other by means of single or double rows of trusses (100) connected one to another by releasable joints in accordance with the invention to form a skeleton for carrying a canopy (780). It will be appreciated that more or fewer towers (30) can be used depending on the capacity required of the building, and a greater or lesser surface area of roof (20) can be employed depending on the requirements and pay laid of the building.

The constructions hereinbefore described are assembled principally from a plurality of trusses (100) which can be releasably secured one to another by means of releasable joints in accordance with the invention. The stage construction is therefore susceptible of rapid assembly and disassembly and offers a significant advantage where the time available for assembling and disassembling such a construction is limited or expensive. The construction can be a building or a stage assembly, and the number and size of the components can be adjusted to provide a construction of a desired specification. In particular the Applicants have found the use of trusses as hereinbefore described formed into spaced rows or columns provides a constructions of great strength which occupies less packed volume when disassembled as compared with prior art scaffolding constructions of similar specifications.

In particularly convenient aspect of the invention, the Applicants have found that the use of a pivotable tower as described herein obviate the need for cranes to erect the towers, and this is particularly advantageous as it permits the erection of a construction in accordance with the invention in locations to which a crane cannot yet access.

We claim:

1. A releasable joint for a transportable construction, said releasable joint comprising:

first and second construction elements, each construction element comprising first and second spaced, substantially parallel, elongate chord portions, each chord portion having first and second ends and defining a recess in at least one of said ends, and bracing components for bracing said first and second chord portions;

first and second spigot members, each spigot member having first and second ends, one end of one of the spigot members being fixedly secured to one end of one of the chord portions of one of the construction elements, and the other end is accommodated within a recess in one end of one of the chord portions of the other construction element, and one end of the other spigot member being fixedly secured to one end of the other chord portion of one of said construction elements, and the other end of the other spigot member being received in a recess in the one end of the other chord member of the other construction element, the other end of each of said spigot members having a first aperture formed therethrough that can be aligned with a respective second aperture formed through the one end of the respective chord portion when the other end of the spigot member is received in the respective recess;

first and second non-threaded spigot securing members, each spigot securing member is entered into a respective pair of said aligned first and second apertures for retaining the other end of each spigot member in the respective recess; and first and second releasable securing components, each securing component releasably securing a respective one of the spigot securing members in the respective pair of aligned first and second apertures.

2. A releasable joint as in claim 1, wherein each end of each chord portion defines a recess, and the one end of each spigot member is fixedly secured in the recess formed in the one end of the respective chord portion.

3. A releasable joint as in claim 1 wherein each non-threaded spigot securing member comprises a nonthreaded pin having a head portion and a stem portion, which stem portion can be entered in the respective pair of first and second aligned apertures.

4. A releasable joint as in claim 3 wherein each releasable securing component comprises a releasable clip, particularly a split pin or an R-clip, which releasable clip can be inserted into an open bore formed through the stem portion of the respective spigot securing member remote from the head portion.

5. A releasable joint as in claim 1, wherein each of said chord portions and spigot members is of rectangular or square cross-section.

6. A transportable construction comprising a plurality of construction elements that are joined releasably one to another by releasable joints in accordance with claim 1.

7. A transportable construction as in claim 6 which comprises a roof.

8. A transportable construction as in claim 6 which comprises a tower for supporting a roof.

9. A transportable construction as in claim 6 comprising a roof and at least one tower wherein the construction elements for use in the roof are interchangeable with the construction elements for use in the tower.

10. A transportable construction as in claim 6 wherein the construction elements forming the construction are arranged in two or more spaced, substantially parallel rows or columns, each row or column being secured releasably to a neighboring row or column by a releasable bracing.

11. A transportable construction as in claim 10 wherein the releasable bracing comprises a plurality of spaced, releasable braces, each releasable brace bracing a respective construction element in one row or column with a corresponding construction element in a neighboring row or column.

12. A transportable construction as in claim 11, wherein each releasable brace comprises a brace member having first and second ends, and first and second releasable brace securing components for releasably securing each of said first and second ends respectively to a respective construction element included in a respective one of the neighboring rows or columns, which releasable brace securing component comprises a bracket member, components for securing the bracket member to the brace member, and bracket securing components for releasably securing the bracket member to the respective construction element.

13. A transportable construction as in claim 12, wherein said bracket member has an aperture formed therethrough, sold aperture being aligned with a corresponding aperture formed in the respective construction element; and said bracket securing component comprises a non-threaded bracket securing member which is entered through the aligned apertures and retained in position by a releasable securing component.

14. A transportable construction as in claim 13, wherein at least one brace member is secured, at least at one of said first and second ends, to the respective construction member in juxtaposition with the one end of the respective construction element, the aperture formed in the bracket member being aligned with the said first and second aligned apertures, and said bracket member being secured releasably to the respective construction element by the said non-threaded spigot securing member that is entered through the aperture formed in the bracket member and said first and second aligned aperture formed respectively in the one end of the construction element and in the other end of the respective spigot member.

15. A transportable construction as in claim 6, further comprising a tower, wherein said tower is provided with a pivot between two neighboring construction elements such that an upper portion of the tower above the pivot can be assembled horizontally on the ground from its, constituent construction elements and then raised into its erect position by pivoting it about said pivot.

16. A transportable construction as in claim 6, wherein a plurality of said construction elements each consist essentially of two spaced, parallel, elongate chord portions, and bracing components for bracing said chord portions.

* * * * *